US010864517B2

(12) United States Patent
Lee et al.

(10) Patent No.: US 10,864,517 B2
(45) **Date of Patent: *Dec. 15, 2020**

(54) VACUUM BATTERY SYSTEM FOR PORTABLE MICROFLUIDIC PUMPING

(71) Applicant: THE REGENTS OF THE UNIVERSITY OF CALIFORNIA, Oakland, CA (US)

(72) Inventors: Luke P. Lee, Orinda, CA (US); Erh-Chia Yeh, Taichung (TW)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 209 days.

This patent is subject to a terminal disclaimer.

(21) Appl. No.: 15/951,582

(22) Filed: Apr. 12, 2018

(65) Prior Publication Data

US 2018/0313345 A1 Nov. 1, 2018

Related U.S. Application Data

(63) Continuation of application No. 15/454,940, filed on Mar. 9, 2017, now Pat. No. 9,970,423, which is a continuation of application No. PCT/US2015/050595, filed on Sep. 17, 2015.

(60) Provisional application No. 62/051,678, filed on Sep. 17, 2014.

(51) Int. Cl.
*B01L 3/00* (2006.01)

(52) U.S. Cl.
CPC ... *B01L 3/50273* (2013.01); *B01L 2300/0816* (2013.01); *B01L 2300/0864* (2013.01); *B01L 2300/0883* (2013.01); *B01L 2400/049* (2013.01)

(58) Field of Classification Search
CPC ..... B01L 2300/0816; B01L 2300/0864; B01L 2300/0883; B01L 2400/049; B01L 3/50273; F04B 19/006
See application file for complete search history.

(56) References Cited

U.S. PATENT DOCUMENTS

| | | | |
|---|---|---|---|
| 7,357,898 | B2 | 4/2008 | Samper |
| 9,970,423 | B2 | 5/2018 | Lee |
| 2005/0266582 | A1 | 12/2005 | Modlin |
| 2006/0088449 | A1 | 4/2006 | Thorsen |
| 2012/0101268 | A1 | 4/2012 | Elizarov |
| 2013/0164778 | A1 | 6/2013 | Janisch |
| 2013/0164779 | A1 | 6/2013 | Kelley |

FOREIGN PATENT DOCUMENTS

WO 2009082535 A2 7/2009

OTHER PUBLICATIONS

State Intellectual Property Office of the People's Republic of China (SIPO), The First Office Action, dated Jul. 20, 2018, related Chinese patent application No. 201580050048.6, Chinese-language document pp. 1-3, English-language translation pp. 4-11, claims examined pp. 12-18.

(Continued)

*Primary Examiner* — Samuel P Siefke
(74) *Attorney, Agent, or Firm* — O'Banion & Ritchey LLP; John P. O'Banion

(57) ABSTRACT

A fluidic chip employing a vacuum void to store vacuum potential for controlled micro-fluidic pumping in conjunction with biomimetic vacuum lungs.

32 Claims, 15 Drawing Sheets

(56) References Cited

OTHER PUBLICATIONS

European Patent Office (EPO), Communication (extended European search report) dated Apr. 16, 2018, related European patent application No. 158413682.2, pp. 1-9, claims searched, pp. 10-14.
Koean Intellectual Property Office (KIPO), International Search Report and Written Opinion dated Dec. 7, 2015, Counterpart PCT International Application No. PCT/US2015/050595, pp. 1-14, with claims searched, pp. 15-21.
Eddings, Mark A. et al., "A PDMS-based gas permeation pump for on-chip fluid handling in microfluidic devices", J. Micromech. Microeng., vol. 16, Sep. 26, 2006, pp. 2396-2402.
Hosokawa, Kazuo et al., "Power-free poly(dimethylsiloxane) microfluidic devices for gold nanoparticle-based DNA analysis", Lab Chip, 2004, 4, 181-185, published online May 12, 2004.

VACUUM BATTERY SYSTEM FOR PORTABLE MICROFLUIDIC PUMPING

CROSS-REFERENCE TO RELATED APPLICATIONS

This application is a continuation of U.S. patent application Ser. No. 15/454,940 filed on Mar. 9, 2017, incorporated herein by reference in its entirety, which is a 35 U.S.C. § 111(a) continuation of PCT international application number PCT/US2015/050595 filed on Sep. 17, 2015, incorporated herein by reference in its entirety, which claims priority to, and the benefit of, U.S. provisional patent application Ser. No. 62/051,678 filed on Sep. 17, 2014, incorporated herein by reference in its entirety. Priority is claimed to each of the foregoing applications.

The above-referenced PCT international application was published as PCT International Publication No. WO 2016/044532 on Mar. 24, 2016, which publication is incorporated herein by reference in its entirety.

STATEMENT REGARDING FEDERALLY SPONSORED RESEARCHER DEVELOPMENT

Not Applicable

INCORPORATION-BY-REFERENCE OF COMPUTER PROGRAM APPENDIX

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND

1. Technical Field

This description pertains generally to diagnostic sensing systems, and more particularly to passive diagnostic sensing systems.

2. Background Discussion

Low cost, power-free, portable, and controlled microfluidic pumping are critical traits needed for next generation disposable point-of-care medical diagnostic chips. Ideally, the pumping system should enable disposable chips to perform on-site testing, where there may be poor infrastructure (i.e. trained technicians, power source, or equipment). Furthermore, the pumping system should provide a platform that is compatible with common quantitative analysis techniques that are usually done in centralized labs such as the Enzyme-Linked Immunosorbent Assay (ELISA) or Polymerase Chain Reaction (PCR). Preferably, the pumping system should also have good optical characteristics so various types of optical detection can be utilized. Finally, it should be simple and robust enough so it can be operated with minimal or no training.

Microfluidic pumping is basically a method to drive fluid flow in miniaturized fluidic systems. Microfluidic pumping can generally be divided into two main categories: active or passive pumping, depending on whether the pumping uses external power sources. Active pumping examples include syringe pumps, peristaltic pumps, membrane based pneumatic valves, centrifugal pumps, electro-wetting on dielectrics (EWOD), electrosmosis, piezoelectric pumps, and surface acoustic wave actuation methods. Typically active pumping systems have more precise flow control and generally larger flow volumes compared to passive systems. However, the requirement of external power sources, peripheral control systems, or mechanical parts makes the devices more bulky, complex, or costly. These barriers make active pumping systems far less feasible for low cost disposable point-of-care systems.

In passive pumping, there are two main types: capillary or degas pumping. These two types are termed passive because these systems typically do not require power sources or peripheral equipment for pumping, thus they are ideal for low cost point-of-care assays. For capillary systems, the lateral flow assay (e.g. pregnancy dipstick tests) is a prevalent commercial example. These assays use fibrous materials to wick bodily fluids in for immunoassays. However, the opaque or reflective fibers can obstruct optical path, or cause higher background noise in fluorescent detection. These reasons make transmission type optical detection, such as fluorescence, phase contrast, and dark-field microscopy difficult to perform in paper capillary formats.

There is also capillary pumping in plastic formats. Glucose test strips are a very common commercial example of this category. These test strips wick blood into a plastic slit for electrochemical detection. However, since capillary force is dependent on geometry, there are intrinsic limitations in design. For example, channels cannot be too thick, and therefore deep (mm scale) optically clear wells with large diameters are not compatible with capillary designs. Flow channels also cannot be too wide, as bubbles may be easily trapped. Periodic structures have been used to prevent bubbles from being trapped, but these structures make the fluidic regions not flat and are less desirable for optical detection, as they can cause excessive scattering; for instance, in dark-field microscopy or total internal reflection microscopy. Furthermore, special surface treatment steps are often needed to render the surfaces hydrophilic/hydrophobic, and flow speeds are highly sensitive to surface tension differences among liquids.

Finally, in all capillary formats, it is not possible to have complete dead-end loading or post degassing to remove bubbles. Dead-end loading is useful in nucleic acid amplification applications as it prevents evaporation. However, dead-end loading cannot be done in capillary systems because an outlet vent for air is always necessary. Dead-end loading and the removal of bubbles are of critical importance if elevated heat processes are involved, such as heat cycling during PCR, since bubbles can expand and cause a catastrophic expulsion of the fluids in the device.

With degas pumping, fluid flow is driven when air pockets diffuse into the surrounding air permeable pre-vacuumed silicone materials, such as polydimethylsiloxane (PDMS). It is analogous to a dry sponge soaking in water, but instead of water, air is diffused into the vacuumed silicone and draws fluid movement. The main advantages of degas loading are the ability to load dead-end chambers, have great optical clarity, and allow for more flexibility in design geometries, as deep and wide structures can be loaded without air bubbles. However, the main drawback is the lack of flow control, and fast exponential decay of flow rate when the device is taken out of vacuum.

BRIEF SUMMARY

The present description includes a medical diagnostic assay with a portable and low cost pumping scheme employing a vacuum battery system, which pre-stores vacuum potential in a void vacuum battery chamber, and discharges the vacuum over gas permeable lung-like structures to drive flow more precisely.

Another aspect is a fluidic chip employing a vacuum void to store vacuum potential for controlled fluidic pumping in conjunction with biomimetic vacuum lungs. The chip exhibits significant advancements in four key areas of flow control compared to conventional degas pumping for use with digital amplification assays, including: more reliable and stable flow, with about 8 times less deviation in loading time and up to about 5 times increase of the decay time constant for a much slower and stable exponential decay in flow rate; reliable pumping for up to about 2 hours without any external power sources or extra peripheral equipment; increased loading speed to up to about 10 times, with a large loading capacity of at least 140 μl; tuning flow and increase flow consistency by varying the vacuum battery volume or vacuum lung surface area.

In one embodiment, the pumping system of the present invention is configured for one-step sample prep and digital amplification, and demonstrated quantitative detection of pathogen DNA (Methicillin-Resistant *Staphylococcus Aureus*) directly from human whole blood samples in one-step (from about 10 to about $10^5$ copies DNA/μl).

Further aspects of the technology will be brought out in the following portions of the specification, wherein the detailed description is for the purpose of fully disclosing preferred embodiments of the technology without placing limitations thereon.

BRIEF DESCRIPTION OF THE SEVERAL VIEWS OF THE DRAWING(S)

The technology described herein will be more fully understood by reference to the following drawings which are for illustrative purposes only:

DETAILED DESCRIPTION

Figure 1:
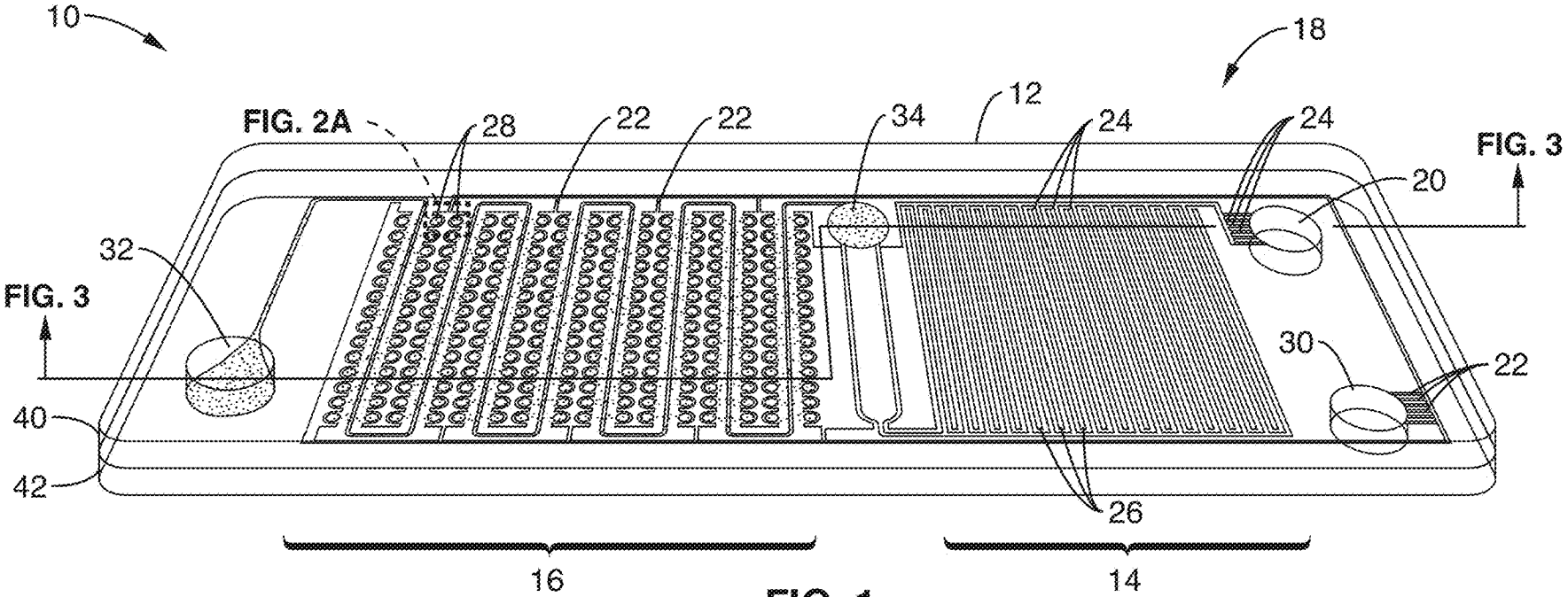
FIG. 1 is perspective view of a medical diagnostic sensing system employing vacuum battery pumping mechanism in accordance with the present description.

FIG. 1 illustrates a medical diagnostic sensing system 10 in the form of a fluidic chip 12 using a vacuum battery configuration for controlled pumping without any external peripheral equipment. Compared to capillary pumping, the chip 12 provides dead-end loading and fewer design constraints in geometry or surface energy. Dead-end loading can enable multiplexed assays such as digital PCR to provide a simple, portable, and low cost technology is ideal for point-of-care diagnostic systems. For purposes of this description, the chip 12 (which may be implemented in microfluidic scales and scales beyond microfluidic applications) is shown in a configuration embodied for liquid samples. However, it will be appreciated that the systems and methods disclosed herein may be implemented on gaseous fluids in addition to liquids. Accordingly, the term "fluid" or "fluidic" is broadly interpreted to mean both gasses and liquids. Furthermore, the term "chip" is broadly defined to mean a device comprising one or more layers of material and/or components, which may or may not be planar in shape.

The chip 12 incorporates a vacuum battery system 18 that includes a main vacuum battery 20 and vacuum lung 14. Vacuum battery system 18 uses voids to pre-store vacuum potential and gradually discharges vacuum via air diffusion through alveoli-like structures (air or vacuum channels 24) of vacuum lung 14 to drive flow of fluid through fluid lines 16 and fluid channels 26. The vacuum battery 20 and vacuum lung 14 components are connected to each other, but not physically connected to nor in fluid communication with the fluid lines 16 or fluid channels 26. As seen in FIG. 1 chip 12 comprises a bi-layer construction having an upper layer 40 and lower layer 42. Layers 40 and 42 are shown opaque in FIG. 1 for clarity.

In a preferred embodiment illustrated in FIG. 1, two vacuum battery components are included on the chip 12 to serve different purposes. The main vacuum battery 20 connects to the vacuum lung 14, and draws air in from the fluid channel 26 via diffusion across the vacuum lung 14. It pumps the main fluid flow that goes from the inlet 32 through fluid lines 16 into the optical window/waste reservoir 34 and the liquid channels 26 from left to right. An auxiliary well-loading vacuum battery 30 is connected to auxiliary vacuum lines or air channels 22 adjacent to and inter-digitating with the dead-end wells 28 (also seen in greater detail in FIG. 2A). As in the main battery system 20, the auxiliary well-loading vacuum battery 30 is not physically connected to the fluid channels 16, and instead only draws air in via diffusion across the thin PDMS wall 25 separating auxiliary channels 22 from wells 28, and assists in making the dead-end well's 28 loading speed faster. It is also appreciated that the auxiliary well-loading battery 30 is optional since conventional degas pumping can still cause the wells 28 to be loaded, albeit at a slower speed.

Dead-end loading is especially useful for PCR reactions because it minimizes evaporation problems. Also, dead-end wells 28 can be useful in digital PCR applications, where one PCR reaction is partitioned and compartmentalized into multiple smaller volumes of reactions, and each chamber is run until saturation for a digital readout. On the other hand, dead-end wells 28 are also useful for multiplexed reactions, for example multiple diseases can be screened in different wells. However, dead-end wells would not be possible to load with capillary loading, and conventional degas pumping is slow. Accordingly, the vacuum battery system 10 is at a unique advantage by demonstrating about 2 times faster dead-end loading (See FIG. 18A and FIG. 18B) compared to conventional degas pumping. Chip 12 as illustrated in FIG. 1 is configured with 224 dead-end wells. However, this is representative of one possible configuration for exemplary purposes, and it is appreciated that other geometric configurations and sizing may be employed.

The vacuum lung 14 is configured to mimics lung alveoli gas exchange by allowing air to diffuse through thin gas-permeable silicone (e.g. PDMS or the like material) walls 25 (defined by inter-digitating air channels 24 and fluid channels 26) from the fluid lines 16 into the vacuum battery 20. It is important to note that the vacuum battery system 18 is not connected to fluid lines 16 or channels 26, as vacuum would be instantly lost once the device is taken out of a vacuum environment if it was connected. Instead, the gas diffusion is controlled across air permeable silicone material by design of the thin walls 25 to regulate flow properties.

The vacuum battery 20 and the vacuum lungs 14, individually, and particularly in combination, greatly improve the pumping characteristics of the system 10 compared to conventional bulk degas pumping in terms of robustness, speed, and operation time.

Figure 2B:
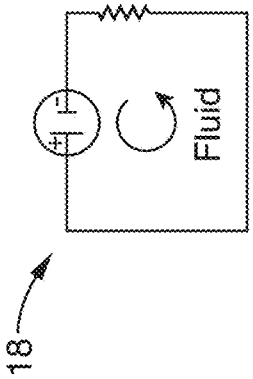
FIG. 2B shows a schematic circuit diagram representative of the vacuum battery system of the present description.
Figure 2A:
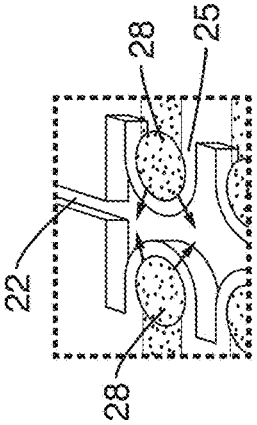
FIG. 2A shows a close-up view of the dead end wells and corresponding inter-digitated air channels in accordance with the present description.

Firstly, the vacuum battery void 20 can provide more vacuum potential storage than bulk PDMS, and therefore more air can be outgassed and resulting in more liquid being sucked in. Since more vacuum is accumulated, a longer operation time is possible. This is analogous to the arranging batteries in parallel to discharge longer. FIG. 2B illustrates a simple circuit diagram of the battery potential via vacuum with regard to the fluid resistance.

Secondly, since the main vacuum potential is stored in the vacuum batteries 20, 30, instead of the bulk PDMS, the system 10 is less susceptible to losing vacuum power from the sides of the chip 12. This contributes to the higher consistency of fluid loading.

Thirdly, air no longer has to diffuse through bulk PDMS material, but only through a thin PDMS wall 25 (e.g. walls between air channels 24 and fluid channels 26 and between auxiliary air channels 22 and dead-end wells 28). This translates into faster and more consistent flow. In conventional bulk degas diffusion, there is a characteristic initial sharp exponential drop in flow rate as air diffuses into the surface layers of PDMS, but becomes much slower afterwards as air takes much longer to diffuse into the bulk material. More consistent flow is possible since vacuum diffuses with a more constant pressure drop across the vacuum lung thin PDMS walls as the vacuum battery provides a large capacitance for vacuum energy storage.

Fourthly, the flow rate can be easily tuned and increased by modifying the surface area of the vacuum lung 14 diffusion area (see FIG. 8A and FIG. 8B) or increasing the vacuum battery 20 volume. The combined effects of the vacuum battery system 18 plus bulk degas pumping also help increase the flow rate.

Additionally, in contrast to capillary pumping, the vacuum battery system 10 enables more flexibility in the design of geometries. In one exemplary configuration, a deep reservoir 34 (e.g. 5 mm diameter, 3 mm height) to retain the excess of pumped liquid. This reservoir 34 enables large loading volumes of liquid to be continuously pumped in. The device can pump in at least 140 μl, and volume can be easily be further increased by punching larger waste reservoirs and vacuum batteries. This is possible because the vacuum battery 20 significantly adds to the vacuum capacity of the device compared to bulk degassing systems. This additional capacity is the driving force that helps outgas the remaining air volume. The reservoir 34 also helps prevent liquid from immediately flowing into the vacuum lung area 14, thus preventing the flow rate to be affected prematurely when the liquid covers the surface area for gas diffusion.

The capacity for a large and deep reservoir 34 is also advantageous for fluorescent or transmission type optical detection, as the Beer Lambart law can be fully utilized since the optical path length is longer. For example, Enzyme-Linked Immunosorbent Assays (ELISA), or real-time PCR assay are common examples that use transmission type optical detection, which can be benefit from system 10.

Figure 3:
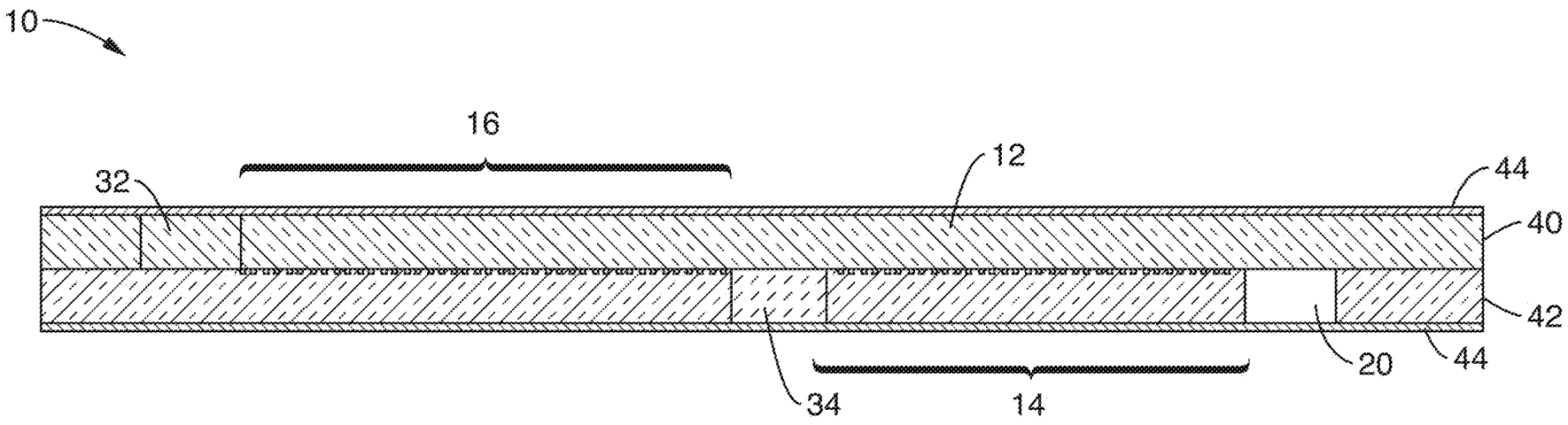
FIG. 3 shows a side-sectional view of the fluidic chip of FIG. 1.

FIG. 3 shows a side-sectional view of the chip 12 of FIG. 1. Upper PDMS layer 40 includes an aperture for inlet 32, and lower PDMS layer 42 comprises reservoir 34, battery cavity 20, and channels for lungs 14 and fluid lines 16. Pressure sensitive adhesive layers 44 may be applied on both the bottom and top surface of the chip 12 to prevent excess gas diffusion.

Figure 4A:
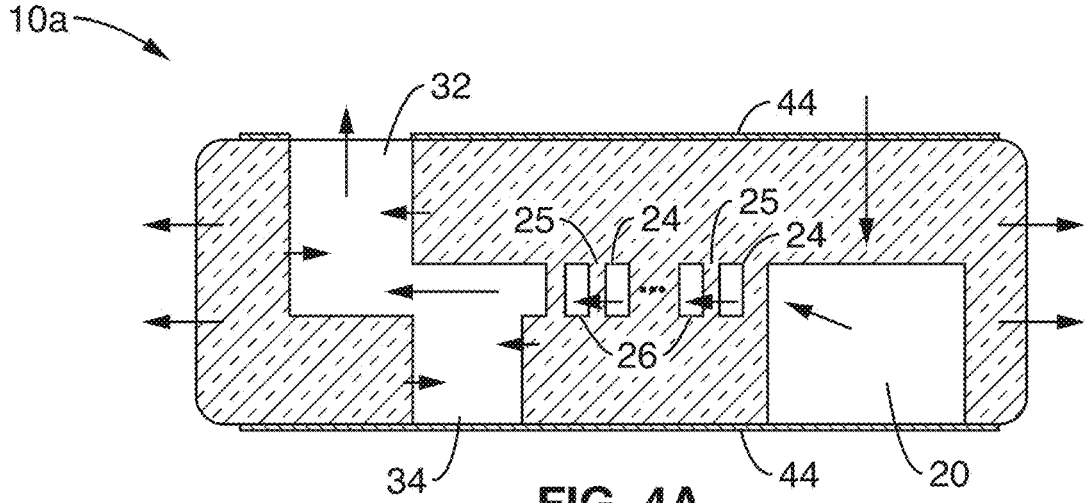
FIG. 4A through FIG. 4C show side-views of a simplified schematic diagram of the vacuum battery-based diagnostic sensing system during charging, storage and discharging operational phases, respectively.
Figure 4B:
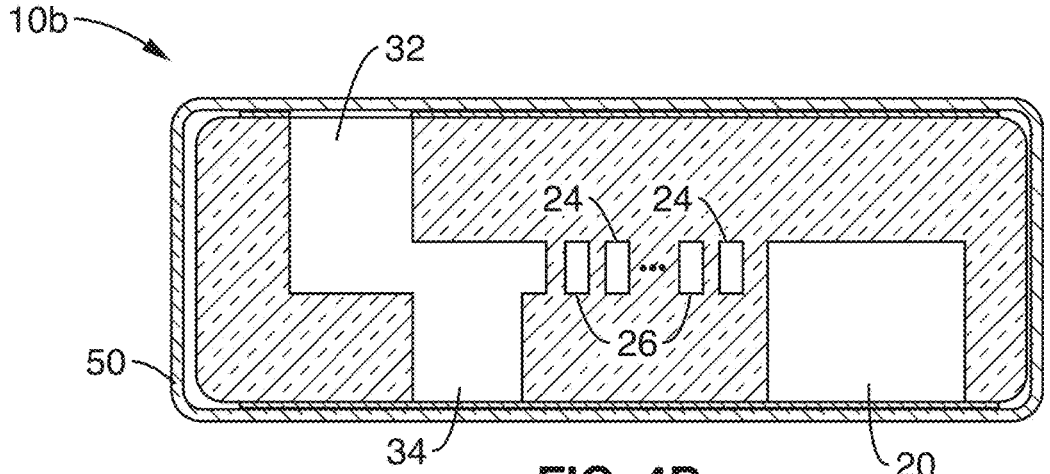
Figure 4C:
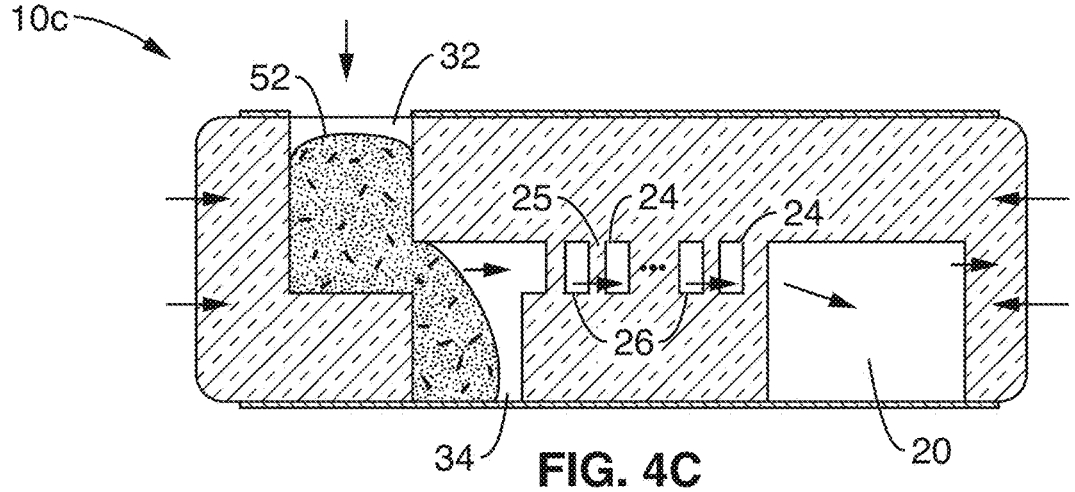
Figure 5A:
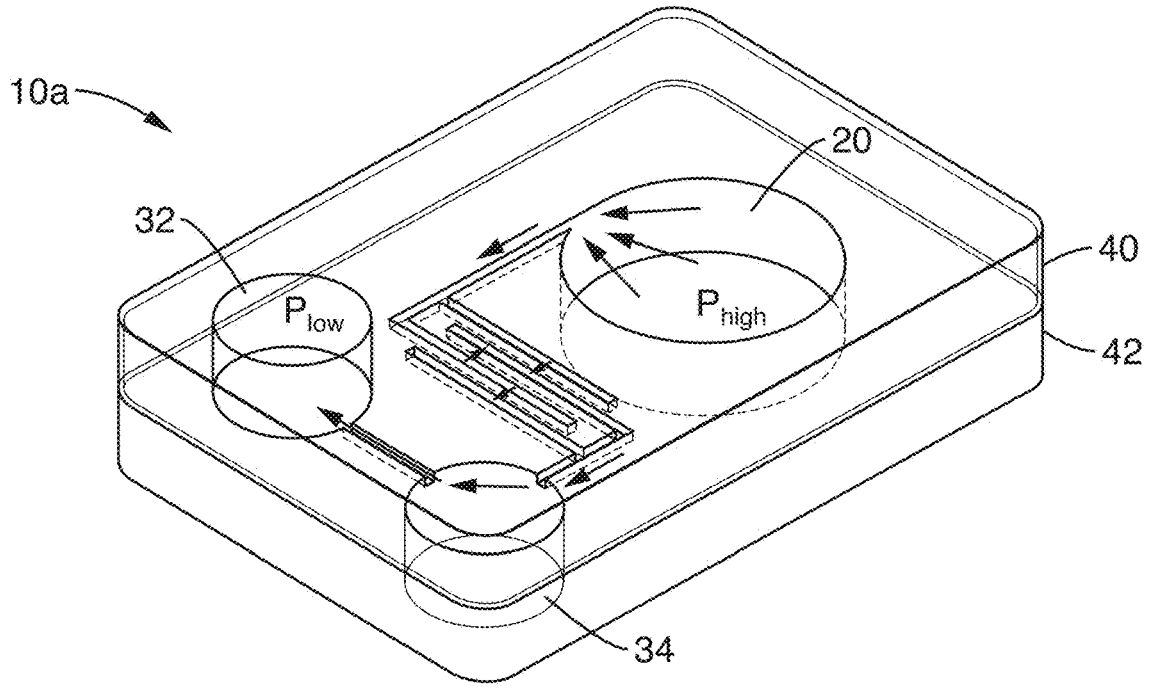
FIG. 5A through FIG. 5C show perspective views of the vacuum battery-based diagnostic sensing system during charging, storage and discharging operational phases, respectively
Figure 5B:
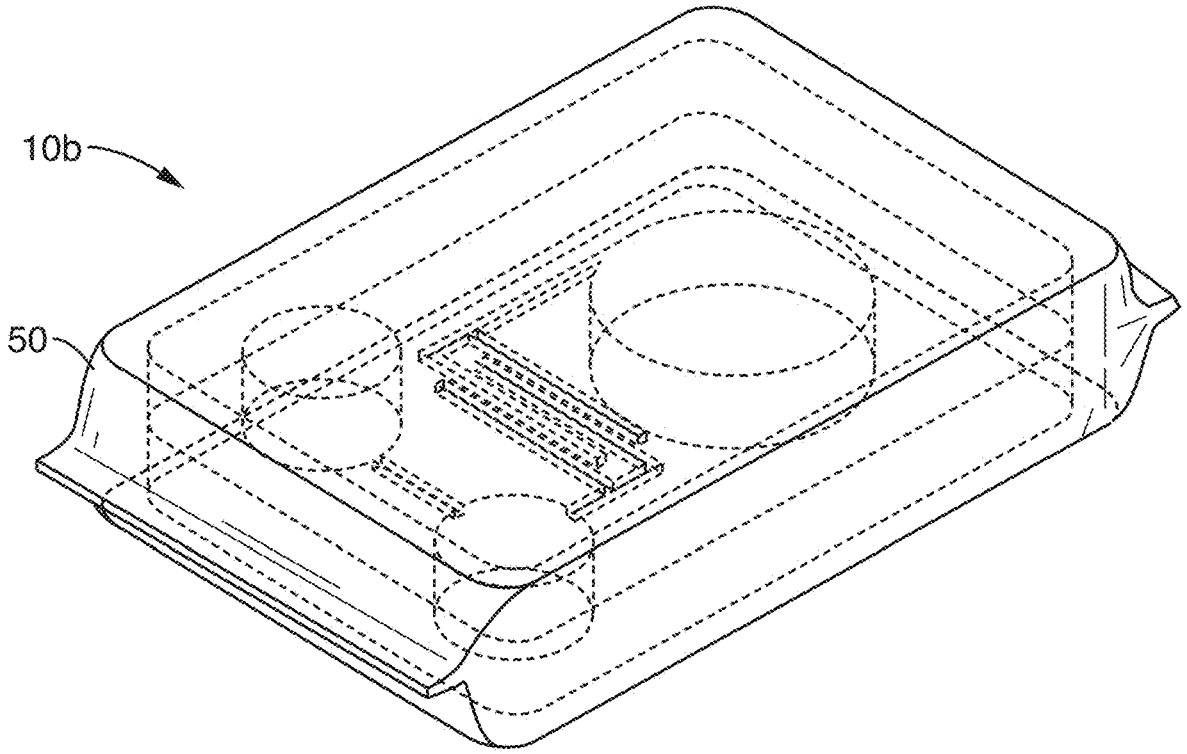
Figure 5C:
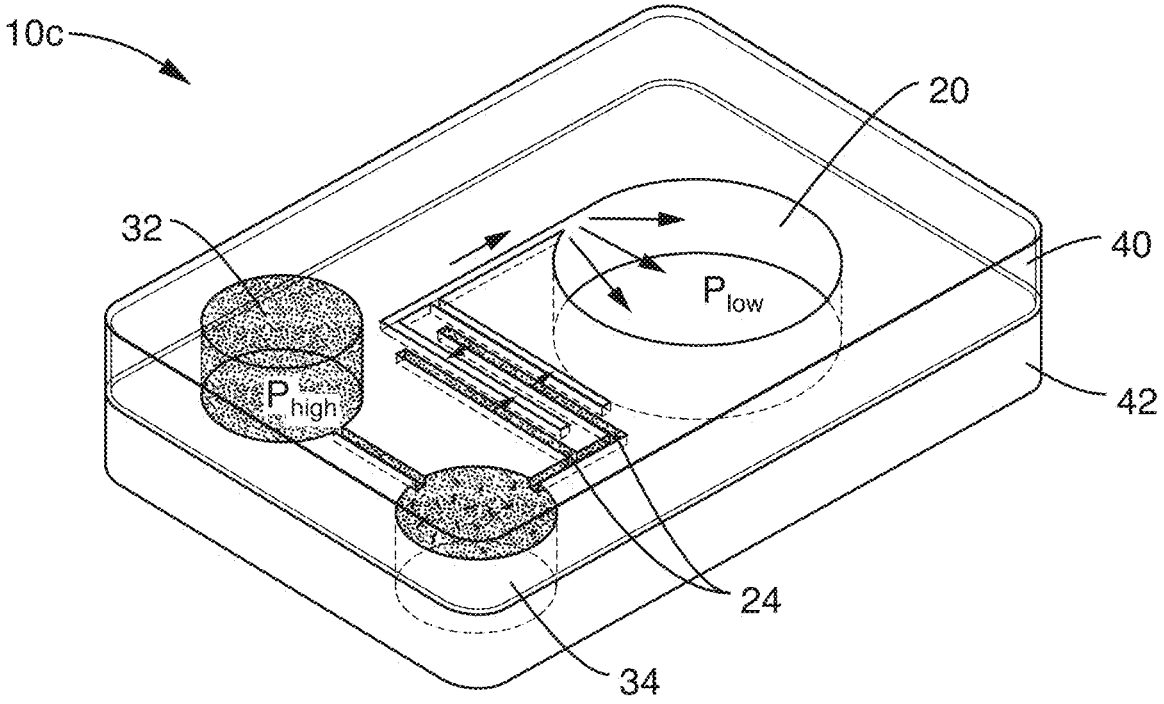

FIG. 4A through FIG. 4C show side-views of a simplified schematic diagram of the vacuum battery-based diagnostic sensing system 10 during charging, storage and discharging operational phases, respectively. FIG. 5A through FIG. 5C show perspective views of the vacuum battery-based diagnostic sensing system 10 during charging, storage and discharging operational phases, respectively. As seen in FIG. 4A through FIG. 4C and FIG. 5A through FIG. 5C, there basically are three cycles for operation of the system, depicted as configurations 10*a*, 10*b*, and 10*c*. An optional waste reservoir 34 is also shown in FIG. 4A through FIG. 4C and FIG. 5A through FIG. 5C. While the waste reservoir helps to increase loading volume, although such reservoir is not necessary for operation.

The first cycle depicted in FIG. 4A and FIG. 5A is the charging phase, where the system 10*a* is put in a vacuum environment and the air from the vacuum battery 20 slowly diffuses out through channels 24, across the thin membranes 25 to the fluid channels 26, and eventually out inlet 32. Air also degasses out of the bulk PDMS material from the sides of the chip 12. This step is generically termed as the "charging vacuum potential" step.

In the second cycle depicted in FIG. 4B and FIG. 5B, the chip 12 is packed with a vacuum-sealing machine in an air-tight seal or containment, e.g. an aluminum pouch 50 or like vacuum containment. This step is primarily performed if long-term storage is needed. The chip 12 can be stored indefinitely and transported easily in such vacuum pouch, which is desirable for point-of-care diagnostic devices. This step is generically termed as the "storage" step. No observable loading speed differences were found with devices that were stored in such pouches for up to a year.

In one embodiment, the chip 12 is incubated in vacuum overnight, and then is sealed in aluminum pouch 50 with a vacuum sealer. A layer of plastic may be laminated on the inside of the aluminum seals (not shown), such that sealing of the pouch 50 may be affected by heating the seams up to melt and seal the pouch 50.

In the third cycle depicted in FIG. 4C and FIG. 5C, the user simply opens the pouch 50 and loads/applies the liquid sample 52 at inlet 32. The vacuum potential from battery 20 and lungs 14 pulls air from the fluid lines 26 across membranes 25 into lungs 24 and battery 20, thus advancing the liquid sample 52 from the inlet 32 into optional reservoir 34 and into fluid channels 26.

It should be noted that FIG. 4A through FIG. 5C are simplified illustrations, and the fluid sample 52 may also be directed through fluid lines 16 and dead-end wells 28 via vacuum potential from auxiliary reservoir 30 as shown in FIG. 1. The third step is generically termed the "discharging" step, and is configured to be is simple and straightforward, so no special training is required to perform it.

Example

The systems and methods of the present description were implemented in a test configuration similar to the system vacuum battery 10 embodied in FIG. 1, and the effects of the vacuum battery system 10 on flow rates were compared with conventional degas pumping.

The tested fluidic chips 12 were fabricated using the standard soft lithography process. A master mold with protruding microfluidic channels was created by photopatterning (e.g. OAI Series 200 Aligner) 300 μm of SU-8 photoresist (e.g. Microchem) onto silicon wafers. Then 3 mm of Polydimethylsiloxane (e.g. PDMS, Sylgard 184, Dow Corning) was poured and cured over the silicon wafer mold to replicate the microfluidic channels. All chips were made to the same size of 25 mm×75 mm by placing a laser cut acrylic cast around the silicone mold, which is the same footprint as a standard microscope glass slide. The waste reservoir was punched by a 5 mm punch. A separate blank piece of 3 mm PDMS would be bonded on the top side to seal the fluidic layer by oxygen plasma bonding. Finally, transparent pressure sensitive adhesives were taped on both the bottom and top surface of the chip to prevent excess gas diffusion.

The vacuum battery void 20 may be fabricated by simply punching the PDMS fluidic layer with through holes before bonding the top and bottom PDMS layers. Different diameters of punchers would be used to fabricate desired vacuum battery volumes. The pressure sensitive adhesive tape used to cover the top and bottom sides may also seal the battery voids into compartments.

To generate the vacuum charge, the chips were incubated at −95 kPa for 24 hours in a vacuum chamber before liquid loading experiments. The chips were sealed in aluminum vacuum packs by a vacuum sealer if long-term storage was necessary.

Parametric studies were performed by varying the operation time gaps, volume of vacuum battery, and surface area of the vacuum lung pairs. Results show that the vacuum battery system increases reliability of the flow, has longer loading windows, has faster loading, and is easy to tune flow.

The effect of the time gap between releasing the chip from vacuum and loading liquids was tested to demonstrate that the vacuum system 10 of the present description provides a sufficient long window of operation so users can load the samples at reasonable times after opening the vacuum seal. A volume of 100 μl of blue food dye was loaded into the inlet 32 of the chip 12 at different time gaps after the chip 12 was taken out of the vacuum. For purposes of this discussion, "digitization" is defined as being complete when all dead-end wells 28 of fluid lines 16 are filled and compartmentalized when the air gap comes in (from left to right in FIG. 1 prior to reaching reservoir 34). Furthermore, "fully loaded" is defined as the point where liquid fills to the end of the vacuum lungs 14 (also from left to right toward the main battery well 20 in FIG. 1).

A time-lapse comparison of actual loading between the vacuum battery system 10 of the present description and conventional degas pumping system was performed. The front section of dead-end wells 28 was compartmentalized to show adaptability for multiplexed reactions. The chips 12 were loaded after being exposed to atmosphere for 10 minutes after taking them out of vacuum. The vacuum battery system 10 finished loading at 40 minutes, while the conventional degas pumping system still had significant portions that were not loaded.

Figure 6A:
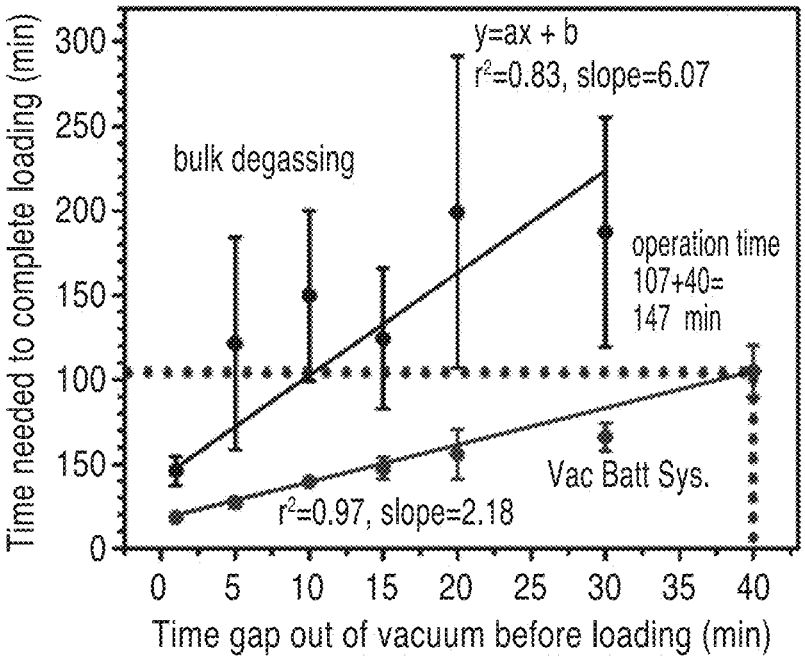
FIG. 6A is a plot showing the effect on flow speed by varying the time gap between taking the device out of vacuum and loading between the system of the present description and a conventional degassing system.

Referring to the time gap and loading graph of FIG. 6A, it was also found that the vacuum battery system 10 was functional for a longer loading time gap for up to 40 minutes, whereas conventional degas pumping failed loading starting at 30 minutes. Even after idling in atmosphere for 40 minutes out of the vacuum, the vacuum battery system 10 still remained functional and continued to pump for another 107 minutes, thus it can be concluded that the vacuum battery system 10 can pump reliably for at least 2 hrs in total.

Though the conventional degas pumping method could continue to load for longer times (e.g. about 50 to about 200 min, FIG. 6A) after the liquid is loaded into the inlet, the more important factor is the length of the initial time gap that the user can load liquids in. Also, a longer post loading pumping time indicates that conventional degas pumping was slower. It was found that regardless of the time gap, loading speed was much faster in the vacuum battery system 10. For example, at 5 minutes after releasing vacuum, the vacuum battery system 10 was 4.5 times faster in loading. Furthermore, the vacuum battery system 10 showed to be much more robust, as it followed a linear trend nicely while conventional degas had much more variation, with $r^2$ values at 0.97 and 0.83, respectively.

Figure 6B:
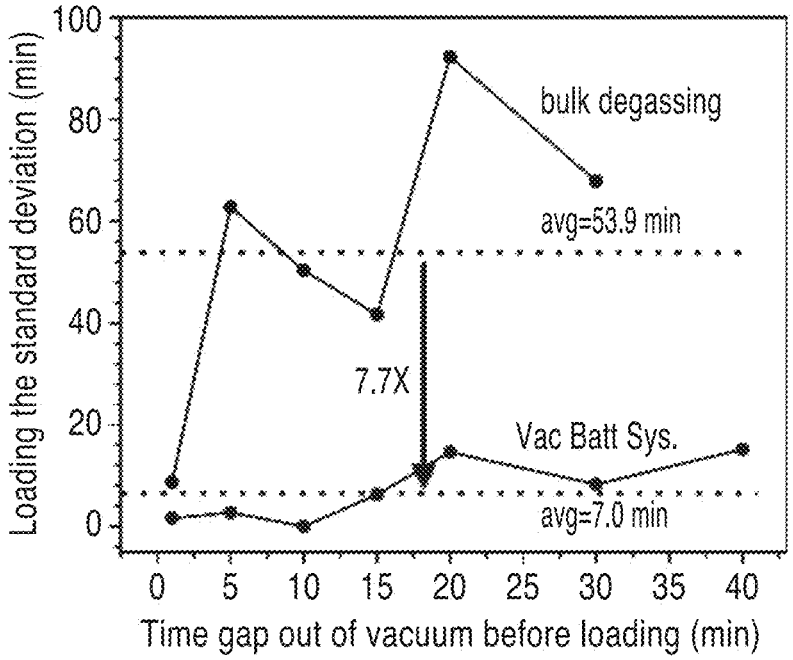
FIG. 6B is a plot showing a comparison of the standard deviation of loading time extracted from FIG. 6A.

FIG. 6B is a plot showing a comparison of the standard deviation of loading time extracted from FIG. 6A. It was found that the vacuum battery system 10 was much more consistent in repeatability, wherein the standard deviation of the loading time of the vacuum battery system 10 was about 8 times less in average than conventional degassing.

Figure 7A:
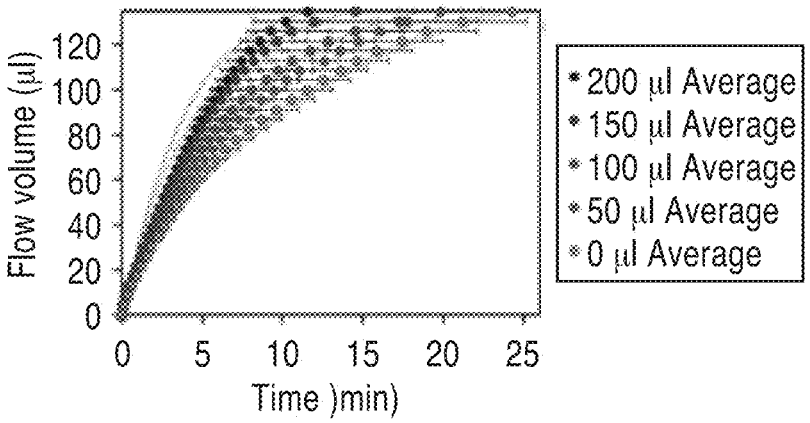
FIG. 7A is a plot showing flow volume vs. time.
Figure 7B:
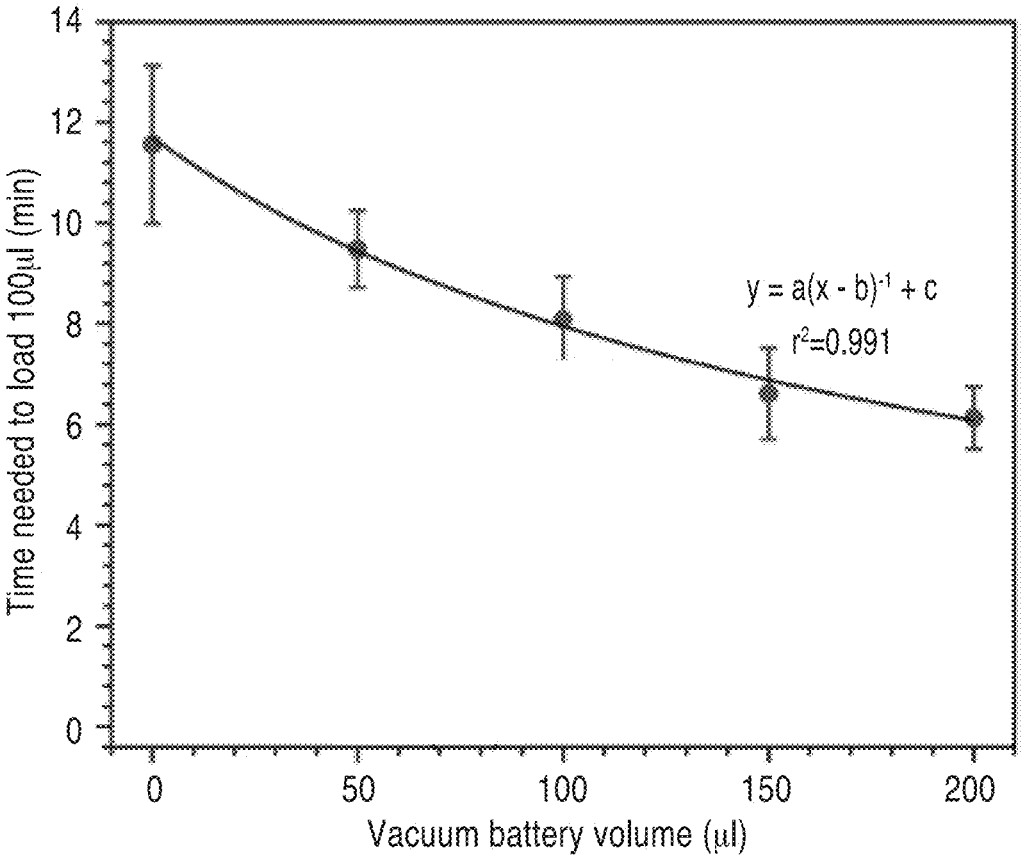
FIG. 7B is a plot showing battery volume vs. time needed to load.

Experiments were also conducted to determine the effect of tuning of flow by varying vacuum battery 20 volume or number of vacuum lung pairs 14. FIG. 7A is a plot showing flow volume vs. time, and FIG. 7B is a plot showing battery volume vs. time needed to load. FIG. 7A and FIG. 7B illustrate fine tuning by varying the stored vacuum potential via change in vacuum battery volume. Time gap out of vacuum was 10 min, with n=3. The auxiliary vacuum battery 30 was kept constant at 100 μl, while the main vacuum battery 20 volume was carried. Aside from increasing flow reliability and speed, it was found out that the larger the battery, the faster the flow rate. However, there was a saturation of flow rate after the battery was larger than 150 μl. Little difference was found in loading times between the 150 μl and 200 μl battery. The simulation results (described in further detail below) were plotted with dashed lines, and agreed well with experimental results that were in dots.

In sum, it was found that the loading time was inversely proportional to the volume of the vacuum battery, and reaches saturation as the volume gets larger. We were able to tune the flow rates at finer increments from about 9.0 μl/min to about 16.7 μl/min. It was possible to easily tune flow rates by simply punching different diameter sizes for the vacuum void 20 after the mold was already fabricated.

Next, the effect of vacuum lung cross-section area on flow characteristics was tested. Coarse tuning may be accomplished by varying the diffusion surface area as a result of changing the number of lung pairs 14.

Figure 8A:
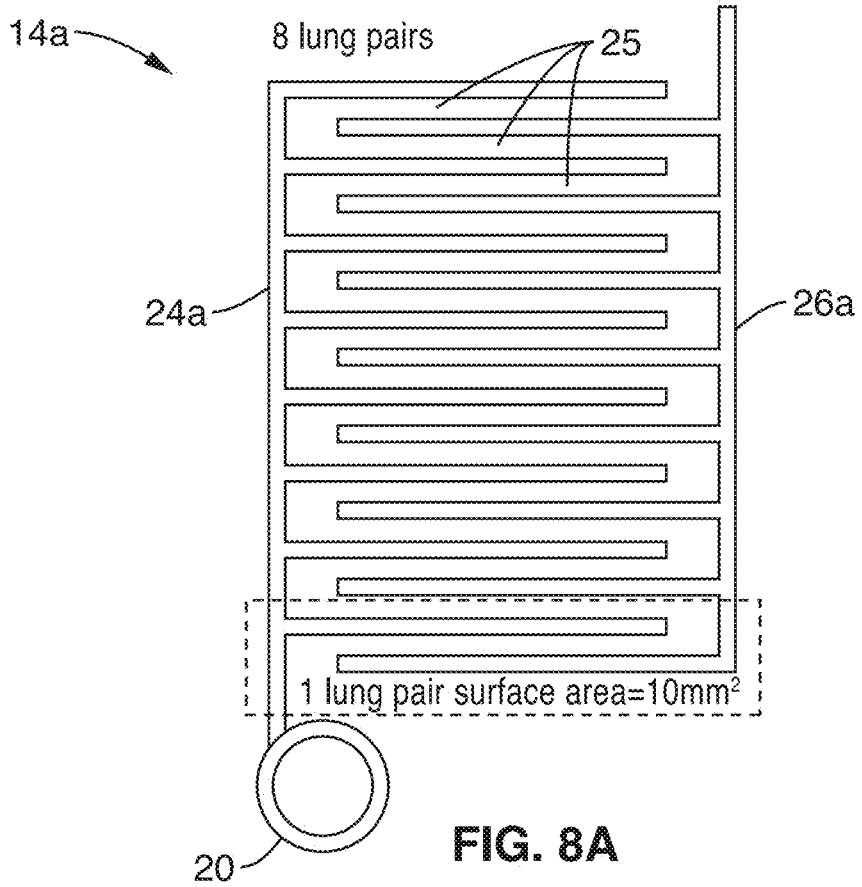
FIG. 8A and FIG. 8B are showing close-up schematic diagrams of an 8-lung pair and 4-lung pair respectively.
Figure 8B:
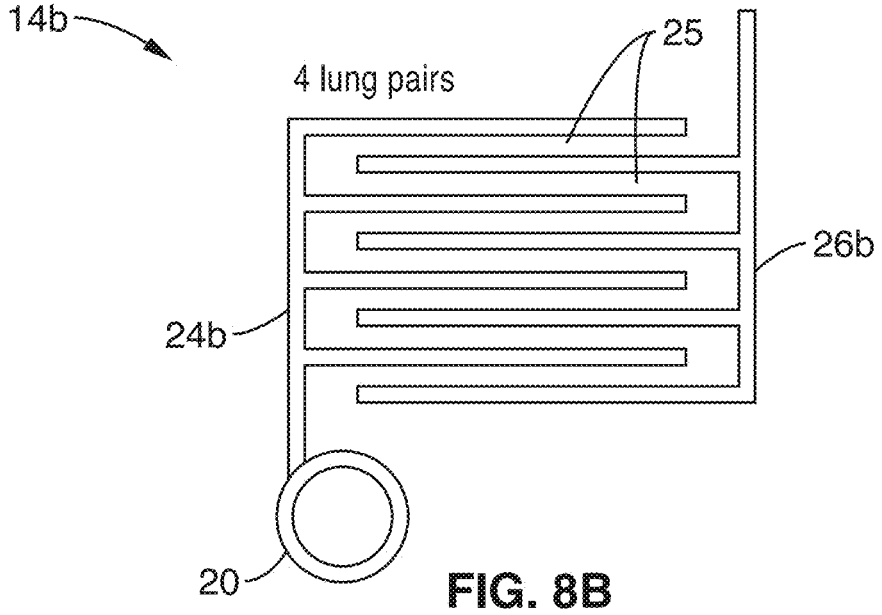

Referring to FIG. 8A and FIG. 8B, showing close-up images of an 8-lung pair 14A and 4-lung pair 14*b* respectively, the gas exchange of the lung alveoli are mimicked by closely staggered fluid channels 26*a*/26*b* and vacuum channels 24*a*/24*b* in an array where a 300 μm thin PDMS membrane separates them. A "lung pair" is defined as one fluid channel 26*a*/26*b* plus one vacuum channel 24*a*/24*b*.

As illustrated in FIG. 8A and FIG. 8B, the fluid and vacuum channels do not physically connect with each other, as all pressure differences are actuated by gas diffusion across the thin PDMS wall. This is similar to the concept that blood vessels do not connect with the atmospheric environment in alveoli, but rely on diffusion for gas exchange. Both the fluid channels 26*a*/26*b* and vacuum channels 24*a*/24*b* were sized at 300 μm in width and height, and 16.8 mm in length. Each lung pair was sized having a 10 $mm^2$ diffusion cross section area. It is appreciated that other sizing and geometry may be contemplated.

Figure 9A:
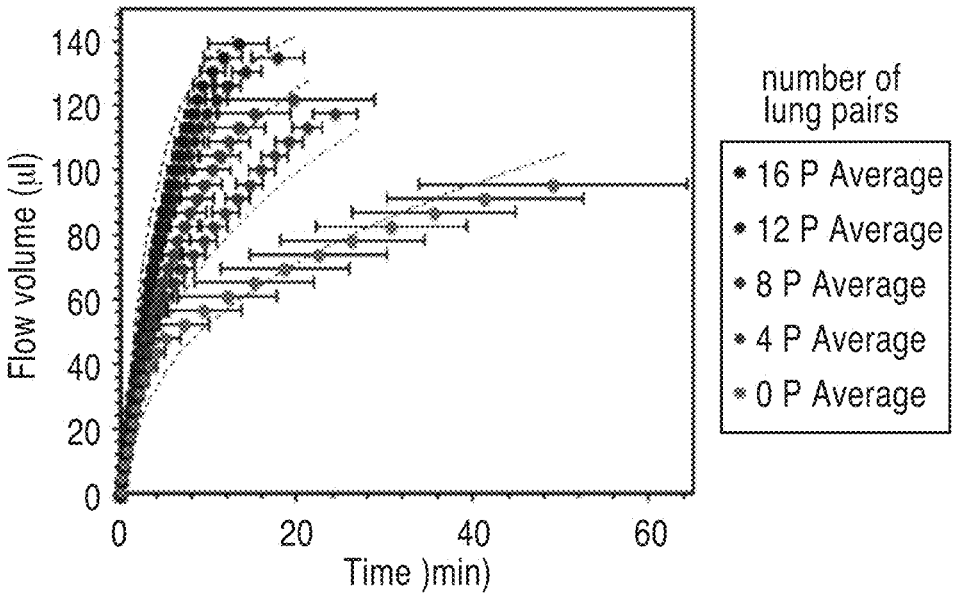
FIG. 9A shows a plot of flow volume vs. time for varying numbers of lung pairs.
Figure 9B:
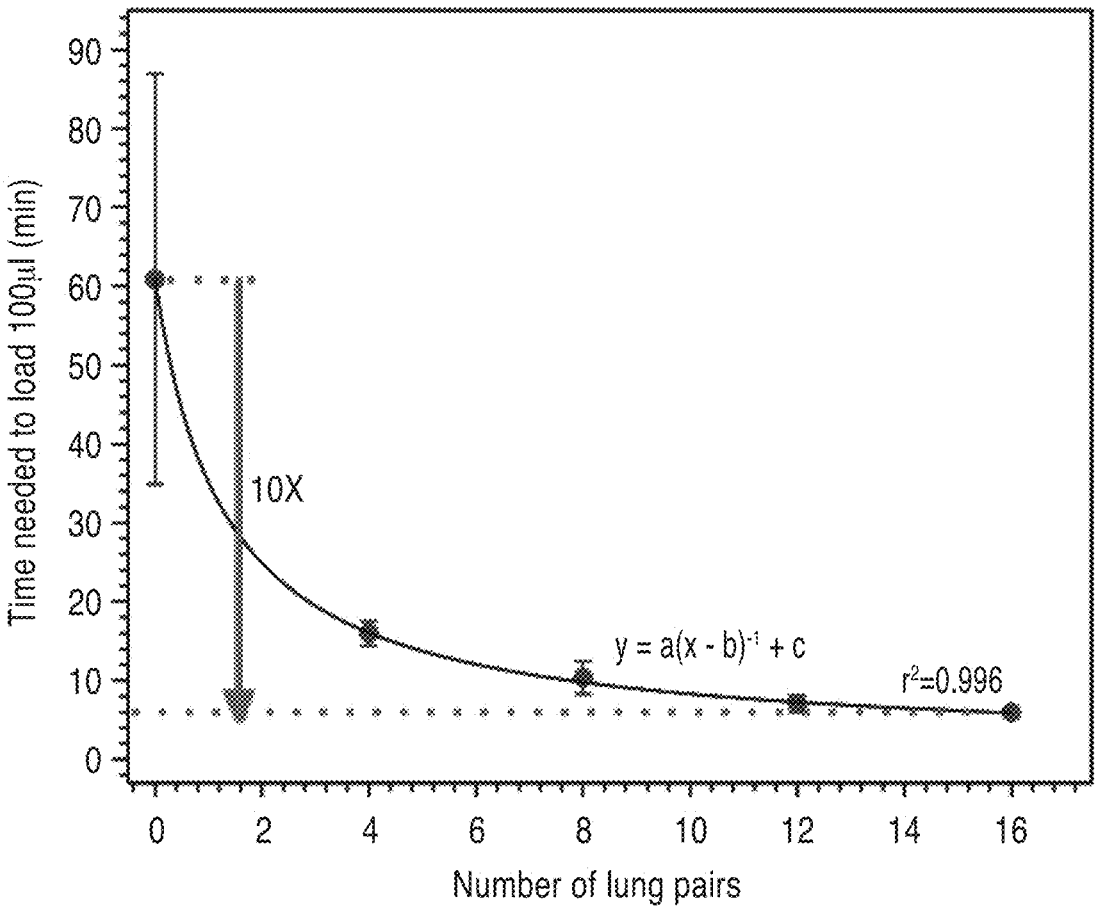
FIG. 9B shows a plot of loading time vs. numbers of lung pairs.

FIG. 9A shows a plot of flow volume vs. time for varying numbers of lung pairs. FIG. 9B shows a plot of loading time vs. numbers of lung pairs. FIG. 9A and FIG. 9B show that the number of lung pairs, which determines the diffusion cross section, is proportional to the flow speed, and loading time was also inversely proportional to the surface area of the diffusion cross-section area. It was possible to tune flow rates with a larger range from about 1.6 to about 18.2 μl/min by adding the number of "lung pairs." The vacuum lungs 14 had a more dramatic effect of increasing loading speed up to 10 times compared to chips that did not have any vacuum lungs. In order to tune flow rates, the mold has to be predesigned with the desired number of lung pairs.

Figure 10:
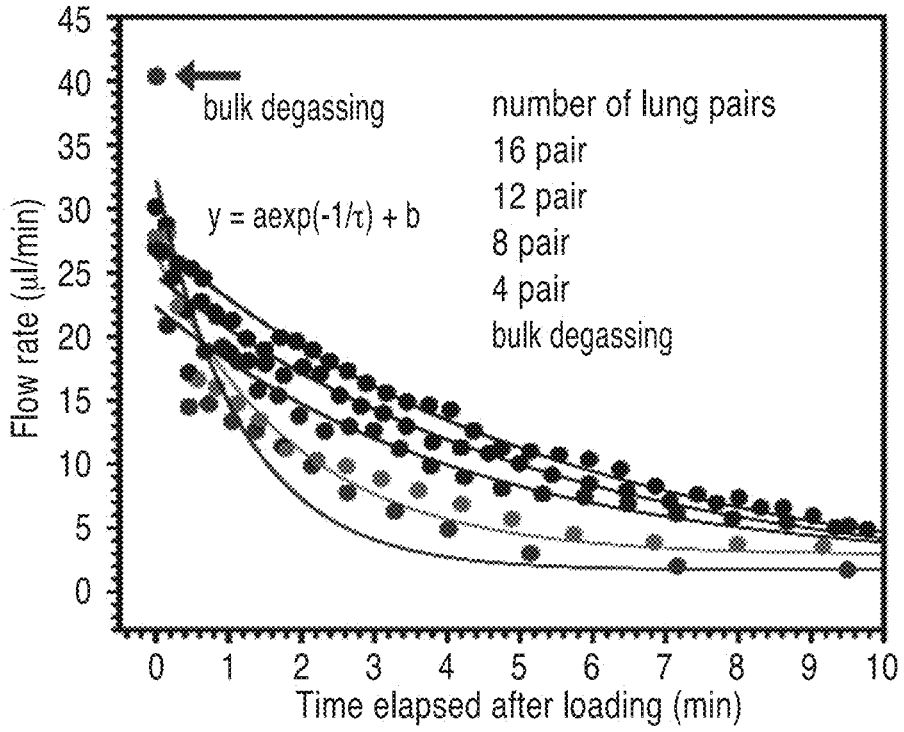
FIG. 10 is a plot of flow rate vs. elapsed time after loading for various lung pair quantities and bulk degassing.
Figure 11:
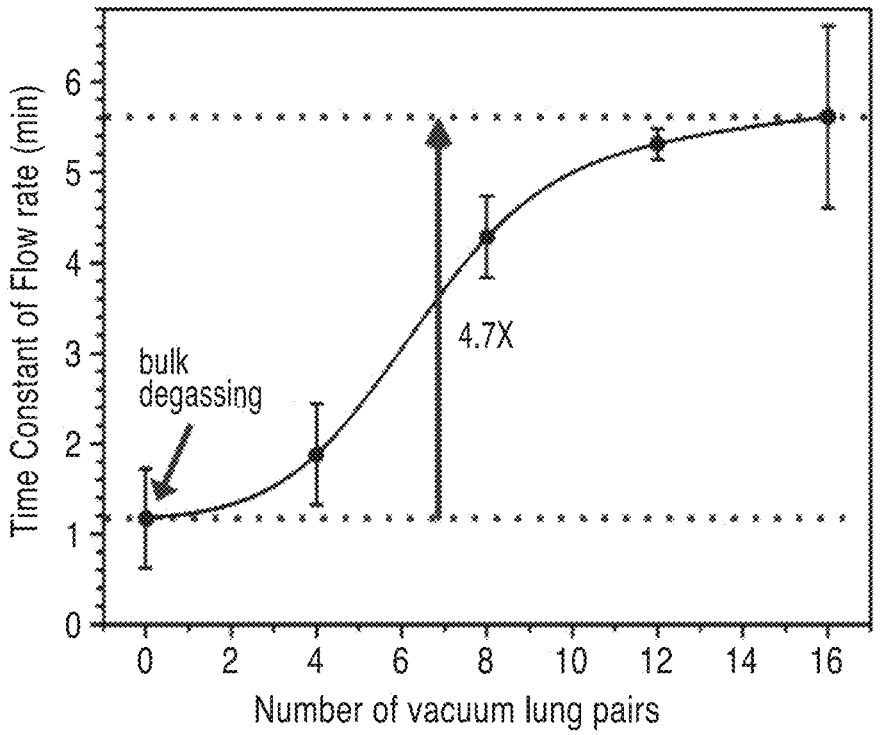
FIG. 11 is a plot of the time constant of flow rate for various lung pair quantities and bulk degassing.
Figure 12A:
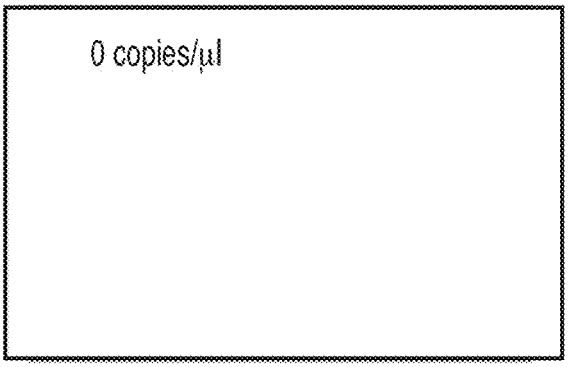
FIG. 12A through FIG. 12F show actual fluorescent images of the reactions (contrast adjusted) and the correlation with nucleic acid concentration.
Figure 12B:
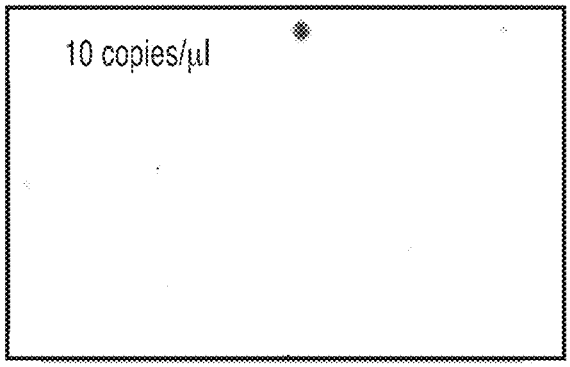
Figure 12C:
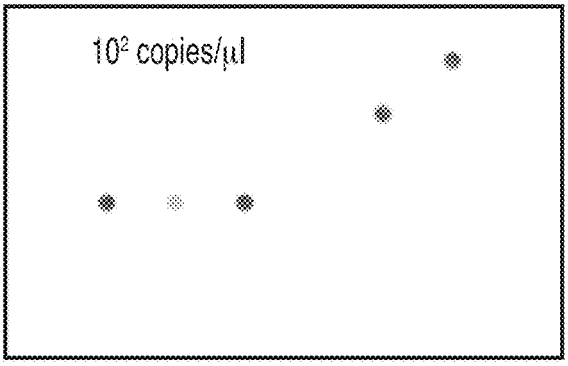
Figure 12D:
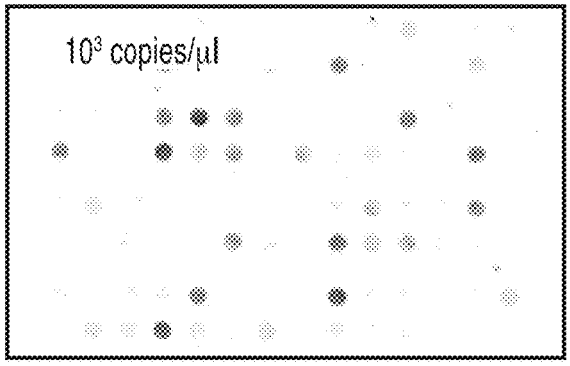
Figure 12E:
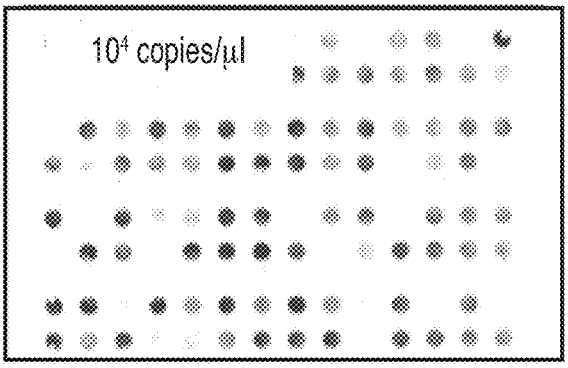
Figure 12F:
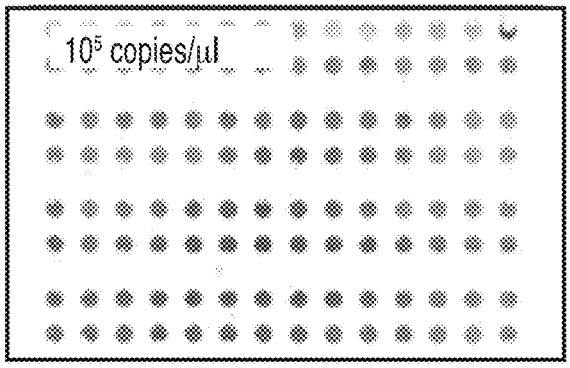

Referring to FIG. 10 and FIG. 11, flow rate decay measurements were also conducted and showed constant flow rates with slower decay with the vacuum battery system 10 than conventional degas pumping systems. FIG. 10 is a plot of flow rate vs. elapsed time after loading for various lung pair quantities and bulk degassing, and shows that flow rates decay slower with the vacuum battery system 10 when there are more lung pairs. The time gap out of vacuum was 15 min. FIG. 11 is a plot of the time constant of flow rate for various lung pair quantities and bulk degassing, and shows the exponential decay time constant is 5 times slower with the vacuum battery system 10 compared to conventional degas pumping. Both vacuum batteries were kept constant at 100 μl for all experiments, n=3.

Figure 13:
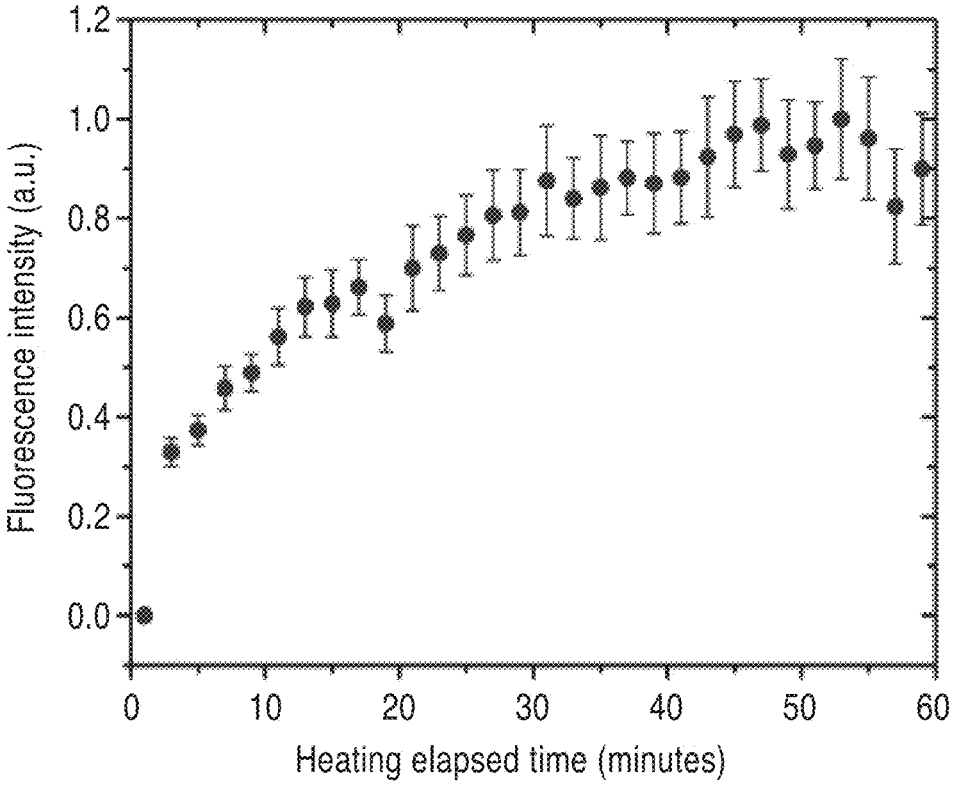
FIG. 13 is a plot of the average intensity of time, showing that the intensity of positive spots increases to a detectable level in 10 minutes.
Figure 14:
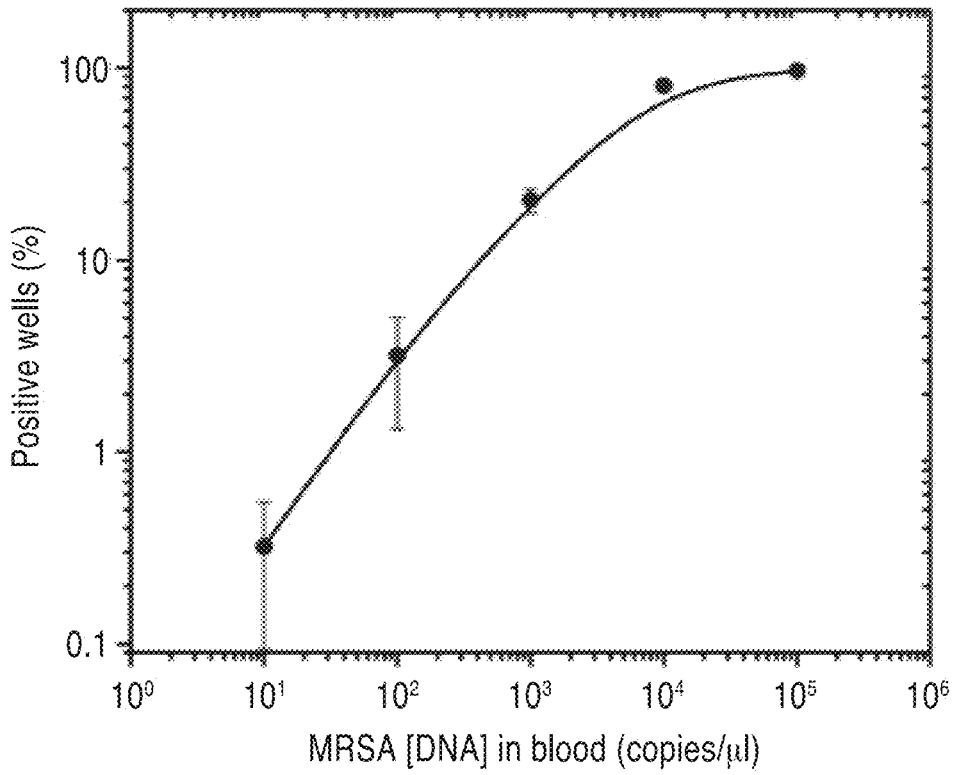
FIG. 14 is a pot showing the detection range of the vacuum battery system.

FIG. 12 through FIG. 14 show results from quantitative digital detection of HIV RNA from human blood using the vacuum battery system 10 of the present disclosure. Isothermal nucleic acid amplification with the recombinase polymerase amplification (RPA) chemistry is demonstrated on system 10. The chip 12 first compartmentalizes the blood sample into 224 wells 28 for digital amplification. RPA reagents are lyophilized in the wells. After compartmentalization, the user places the chip on an instant heat pack and incubates for at least 30 minutes, then an end point fluorescent count is taken of how many wells show positive. FIG. 12A through FIG. 12F show actual fluorescent images of the reactions (contrast adjusted) and the correlation with nucleic acid concentration. FIG. 13 is a plot of the average intensity of time, showing that the intensity of positive spots increases to a detectable level in 10 minutes. FIG. 14 is a pot showing the detection range of the system 10. MRSA DNA was spiked into human whole blood for these tests.

Figure 17A:
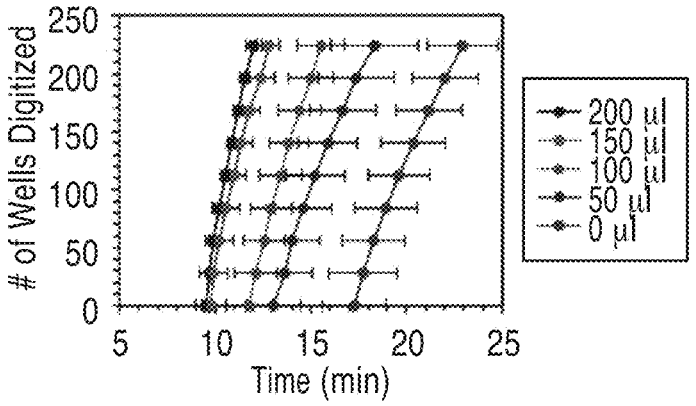
FIG. 17A is a plot showing the number of wells digitized over time for various lung configurations.
Figure 17B:
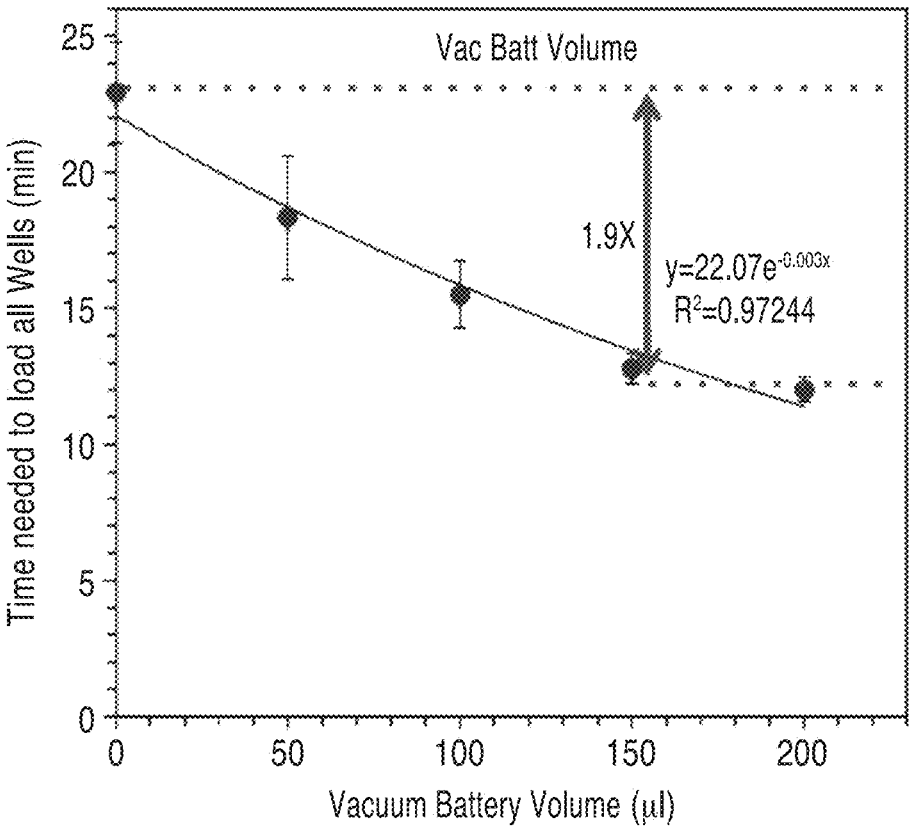
FIG. 17B is a plot showing the time needed to load all wells for various battery volumes.

Referring to the plots of FIG. 17A (showing number of wells digitized over time) and FIG. 17B (showing the time needed to load all wells for various battery volumes), the time needed to load all the wells was showed to decrease on increasing battery volume. Furthermore, loading and compartmentalization of all wells was completed in 12 minutes with the vacuum battery system 10 (solid line in FIG. 17B), whereas conventional degassing well loading took 23 minutes (dashed line in FIG. 17B).

Figure 18A:
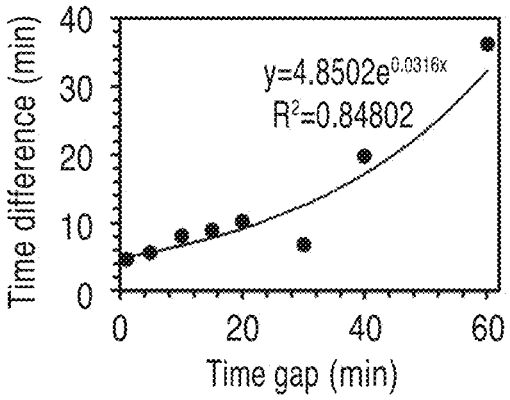
FIG. 18A and FIG. 18B are plots illustrating the change in digitization speed by varying the loading time gap.
Figure 18B:
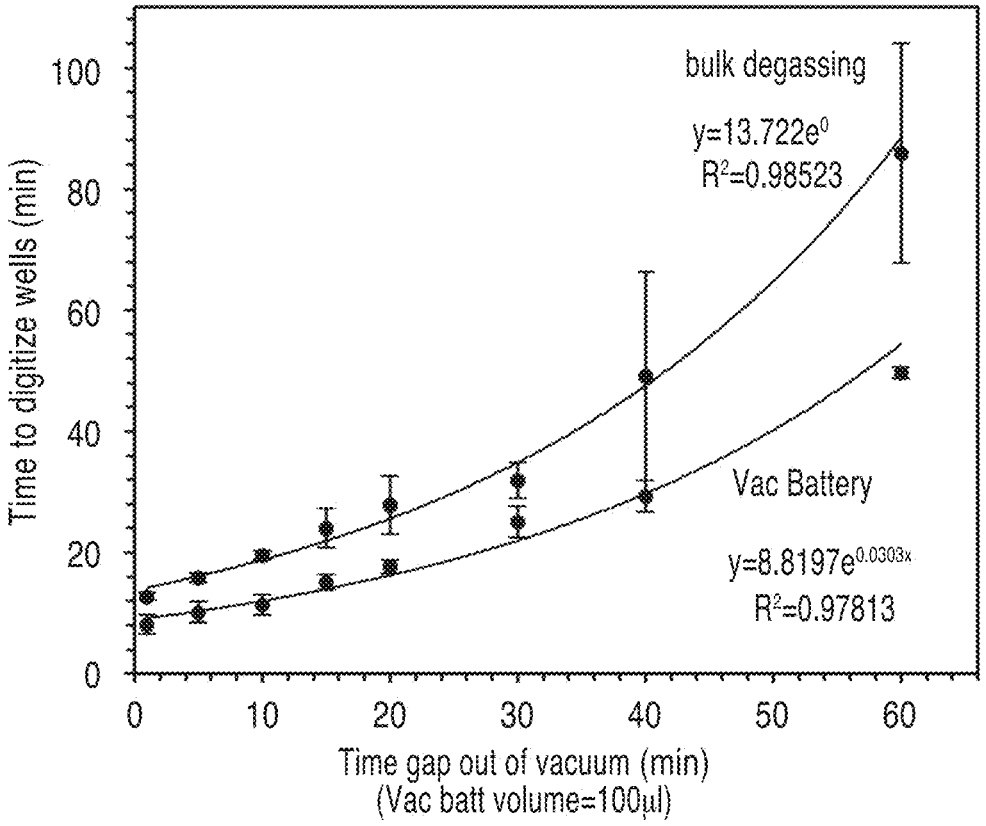

The digitization speed of the wells 28 was also characterized by varying the loading time gap, as illustrated in the plots of FIG. 18A and FIG. 18B, demonstrating about 2 times faster dead-end loading compared to conventional degas pumping.

Figure 15:
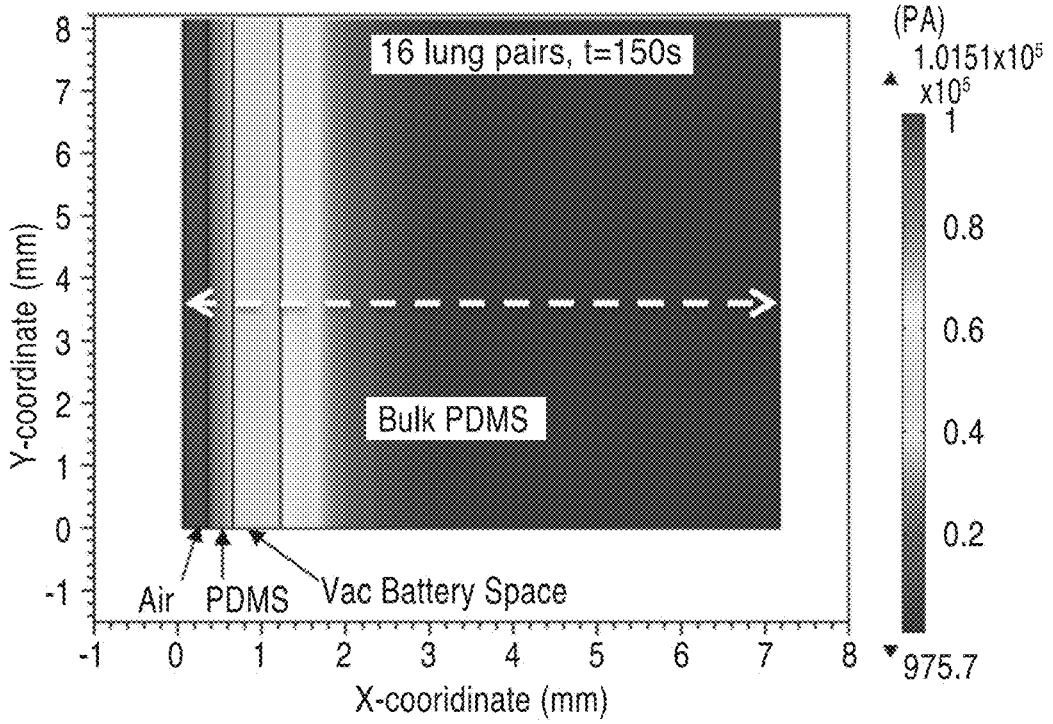
FIG. 15 shows a simplified 2-D diffusion model of a vacuum battery chip in accordance with the present description.

Referring now to FIG. 15, a simplified 2-D diffusion model was built with the COMSOL simulation software using the convection diffusion equation. The vacuum battery system 10 was simplified into a 2D model with four regions, from left to right, the fluid channel 16 where air is being drawn out, the thin PDMS membrane (between channels 24 and 26) of the vacuum lungs 14 to control diffusion speed, the vacuum battery void space 20 to store vacuum potential, and the surrounding bulk PDMS material. Within the PDMS regions, it assumed that there was no convection. Air diffuses gradually from the left to right regions.

The above experiments also demonstrated that it was possible to design wide fluidic channels (e.g. 3×15 mm, 300 μm height) in the chip 12 and load without any bubbles, which has been previously difficult to perform in capillary or plastic microfluidic systems, where trapping of bubbles is a common problem in wider geometries. It is critical to minimize bubbles in microfluidic systems, as they can easily clog channels, or cause catastrophic ejection of liquid when heated due to thermal expansion. This is a particular problem in PCR assays.

Figure 16:
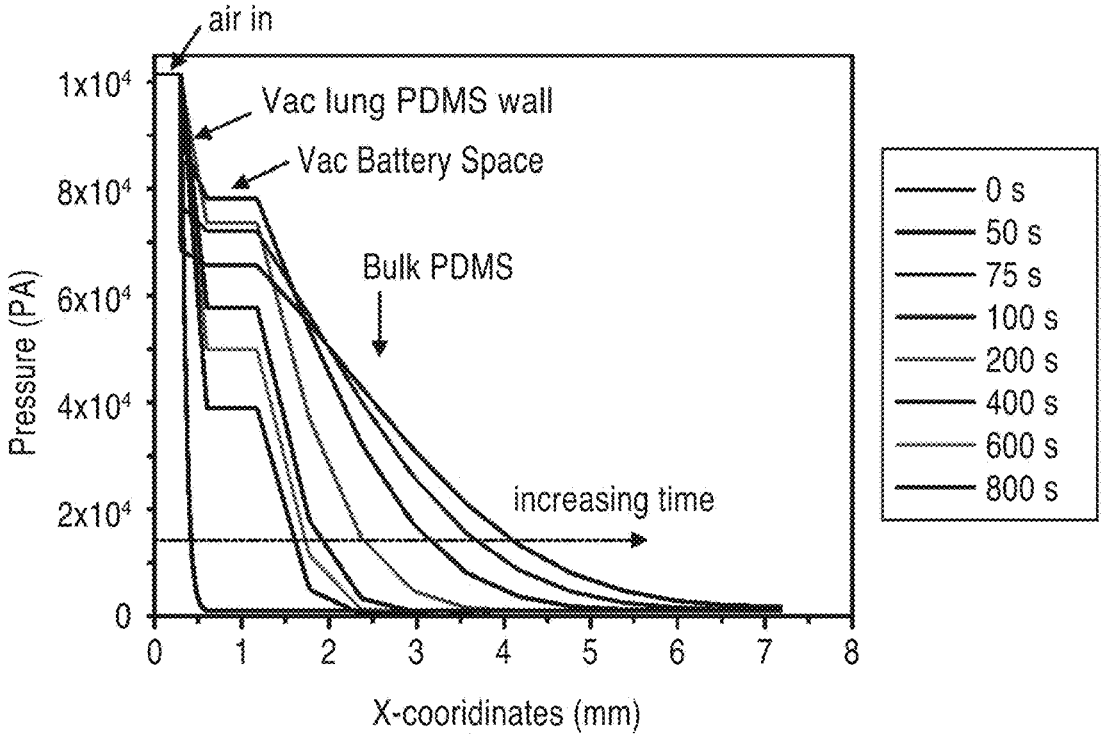
FIG. 16 shows the simulated pressure profile of the dashed line in FIG. 15.

FIG. 16 shows the simulated pressure profile of the dashed line in FIG. 15. As time increases, the vacuum battery void space 20 first fills with air, then it gradually diffuses into the bulk PDMS. The bulk PDMS degassing follows a characteristic exponential decay in pressure.

The air diffusion across from the fluid channels through the PDMS vacuum lungs into the vacuum battery space can be described with the convection-diffusion equation:

$$\frac{\partial c_i}{\partial t} = \nabla \cdot (D_i \nabla c_i) - \nabla \cdot (\vec{u} c_i) \quad \text{Eq. 1}$$

where $c_i$ denotes the concentration species of air in the fluid channel, PDMS, or vacuum battery. $D_i$ is the diffusion constant of air in each regime, and $\vec{u}$ is the convection velocity vector in the fluid channel and vacuum battery. In the bulk PDMS, there is no convection, therefore the equation simplifies into Fick's second law:

$$\frac{\partial c_i}{\partial t} = D \nabla^2 c_i \quad \text{Eq. 2}$$

The pressure in the fluid channels and vacuum battery can be found by correlating the gas concentration via the ideal gas law:

$$P = \frac{n}{V} RT = cRT \quad \text{Eq. 3}$$

where P is the pressure, V is the volume, n is number of moles, R is the Avogadro number, and T is the temperature. The volume of liquid being sucked in the device is the same volume of air that has diffused into the vacuum battery and PDMS. This volume can be calculated by integrating the flux of air concentration being degassed over time and surface area. Pressure changes against time plots are shown in FIG. 16.

In conclusion, the battery vacuum system and methods of the present disclosure provide significant advantages over conventional degas pumping via extended (about 2 hrs) and reliable flow (about 8 times less standard deviation in loading time). Loading speed was easily tuned and enhanced up to 10 times by varying the diffusion area of vacuum lungs or changing the size of the vacuum void. In one exemplary configuration, the pumping mechanism of the battery vacuum system is capable of loading at least 140 μl of liquid, and compartmentalizing liquids into hundreds of dead-end wells for digital amplification or multiplexed assay applications.

Since the vacuum battery chips 12 can be easily integrated into optically clear microfluidic circuits while leaving design flexibility for different geometry, they are particularly advantageous applications using controlled pumping in low cost power-free handheld devices. The vacuum battery system 10 is also particularly useful in point-of-care diagnostics, as the system is robust and requires no technical skill or extra peripheral equipment/power sources for operation. As a demonstration of its utility, the vacuum battery system was integrated with isothermal digital nucleic acid amplification and sample prep for quantitative detection of Methicillin-Resistant *Staphylococcus Aureus* (MRSA) DNA directly from human blood samples.

It was shown that the vacuum batteries and vacuum lungs of the present description contributed to more consistent flow rates, as the slope of loading was more linear. It was also shown that the vacuum lungs increase not only the loading speed, but also the flow stability. Flow rate followed the characteristic exponential decay over time as in conventional degas pumping, however, the flow rate decay could be made much slower when there are more lung pairs. We were able to increase the exponential decay time constant about 5 times with this prototype. We anticipate that is it possible to further optimize the vacuum battery system to make the decay time constant even longer by adding extra vacuum batteries and additional secondary degas lungs to degas and stabilize the primary vacuum battery.

The vacuum battery system was integrated with a digital plasma separation system that is capable of separating plasma via "microcliff structures" into hundreds to thousands of nano-liter scale wells to perform digital amplification. Different spiked DNA concentrations were tested using an isothermal nucleic acid amplification technique called Recombinase Polymerase Amplifcation (RPA). Quantitative detection of MRSA DNA from about 10 to about $10^5$ copies/μl directly from spiked human whole blood was achieved.

The vacuum battery system also demonstrated loading of a large array of dead-end wells (224 in total) without trapping any bubbles up to 2 times faster. These dead-end wells may be implemented in multiplexed assays or digital PCR assays. Faster bubble-free loading of large optical windows and deep wells were shown, which are useful in transmission type optical detection. The vacuum battery system does not require any special surface treatment and has more flexibility for channel geometry design, as it does not rely on surface tension or capillary action to drive flow.

The attributes of the vacuum battery system may also be tuned according to one or more of the following: (1) increase the vacuum battery void if longer operation time or sample volume is needed; (2) increase the number of vacuum lung pairs if faster flow speed is desired, (3) increase the waste reservoir volume if larger sample volumes are necessary.

Furthermore, pumping components of the system may be directly integrated into the chip 12 and can be easily manufactured by molding. For mass production, PDMS can be replaced by the use of injection molding compatible gas permeable elastomers (e.g. liquid silicone, TPE, etc.). In one embodiment, the chip construction only uses two layers, thus it can be manufactured at low cost. Furthermore, flow rate can be further stabilized by adding second order vacuum battery systems to degas the main battery system 18.

In summary, compared to conventional degas loading, the vacuum battery system provides significantly more reliable flow, longer operational time, faster flow, and easy tunablity of flow rates. In addition, it overcomes several limitations of capillary loading. The vacuum battery system is able to load dead-end wells, load deep or wide geometries without bubbles, and has excellent transparent optical properties. This simple system is easy to operate, can be stored for long term, is convenient to transport, and can be operated on-site without any external power sources or equipment. This translates into numerous applications, such as performing on-site ELISA, digital PCR, or multiplexed digital nucleic acid amplification.

For at least these reasons, the vacuum battery system 10 provides an ideal alternative platform technology from capillary systems or conventional degas pumping for handheld point-of-care devices.

From the description herein, it will be appreciated that that the present disclosure encompasses multiple embodiments which include, but are not limited to, the following:

1. A system for portable fluidic pumping, the system comprising: a chip; a void disposed within the chip; the void comprising a volume configured to store a vacuum upon subjecting the chip to a vacuum state; a vacuum channel coupled to and in communication with the void; a fluid channel disposed adjacent to the vacuum channel such that a thin gas-permeable wall of material is disposed between the fluid channel and the vacuum channel; wherein the fluid channel and vacuum channel are not physically connected to each other; and a containment for maintaining the chip in said vacuum state; wherein upon release of the chip from the vacuum state in the containment, the stored vacuum within the void passively draws air across the thin gas-permeable wall into the void to advance a fluid sample into the fluid channel.

2. The system of any preceding embodiment: wherein the vacuum channel comprises a plurality of vacuum channels and the fluid channel comprises a plurality of fluid channels; and wherein the vacuum channels are inter-digitated with the plurality of fluid channels to form a vacuum lung of thin gas-permeable walls.

3. The system of any preceding embodiment, wherein the vacuum lung is configured to mimic lung alveoli gas exchange by allowing air to diffuse across the thin gas-permeable walls between the fluid channels and the vacuum channels and void.

4. The system of any preceding embodiment, wherein the lung is configured to control gas diffusion across the thin gas-permeable walls, thereby regulating flow properties of fluid in the fluid channels.

5. The system of any preceding embodiment: wherein the fluid channel further comprises a plurality of dead-end wells coupled in series; and wherein the fluid sample is configured to be sequentially drawn into the plurality of dead-end wells.

6. The system of any preceding embodiment, further comprising: a plurality of auxiliary vacuum channels inter-digitated with the plurality of dead end wells to form a second set of thin gas-permeable walls between the dead-end wells and auxiliary vacuum channels; and wherein upon release of the chip from the vacuum state, air is drawn across the second set of thin gas-permeable walls to advance the fluid sample into the plurality of dead-end wells.

7. The system of any preceding embodiment, further comprising: an auxiliary void coupled to the auxiliary vacuum channels; the auxiliary void comprising a volume configured to store a vacuum upon subjecting the chip to a vacuum state; wherein upon release of the chip from the vacuum state, the stored vacuum within the auxiliary void draws air across the second set of thin gas-permeable walls to advance the into the plurality of dead-end wells.

8. The system of any preceding embodiment, further comprising: a reservoir coupled to the fluid channel; wherein upon release of the chip from the vacuum state, fluid is advanced from the inlet into the reservoir along the fluid channel.

9. The system of any preceding embodiment, further comprising: a reservoir coupled to the fluid channel; and an inlet disposed in the chip; the inlet being coupled to and in communication with the fluid channel and configured to receive a sample fluid; wherein upon release of the chip from the vacuum state, fluid is advanced from the inlet and sequentially through the plurality of dead-end wells, the reservoir, and then the plurality of fluid channels.

10. The system of any preceding embodiment, wherein the chip comprises: a first layer of gas-permeable material; the first layer comprising one or more of the vacuum channel, fluid channel, and void; and a second layer capping the first layer to close off one or more of the vacuum channel, fluid channel, and void.

11. The system of any preceding embodiment: wherein the chip comprises multiple layers; and wherein one or more of the vacuum channel, fluid channel, and void are disposed on separate layers.

12. A method for portable fluidic pumping on a chip, the system comprising: providing a chip comprising a void, a vacuum channel and a fluid channel disposed within the chip, wherein the vacuum channel is coupled to and in communication with the void and the fluid channel is disposed adjacent to the vacuum channel such that a thin gas-permeable wall of material is disposed between the fluid channel and the vacuum channel; applying a vacuum to the chip to charge the chip to store a vacuum within the void; storing the chip to maintain the vacuum; discharging the chip from the vacuum; applying a fluid sample at a location on the chip; and as a result of the stored vacuum within the void, passively drawing air across the thin gas-permeable wall into the void to advance the fluid sample into the fluid channel.

13. The method of any preceding embodiment, wherein storing the chip to maintain the vacuum comprises placing the chip in a vacuum-sealed pouch.

14. The method of any preceding embodiment, wherein discharging the chip comprises opening the vacuum-sealed pouch to break the vacuum.

15. The method of any preceding embodiment: wherein the vacuum channel comprises a plurality of vacuum channels and the fluid channel comprises a plurality of fluid channels; and wherein the plurality of vacuum channels are inter-digitated with the plurality of fluid channels to form a vacuum lung of thin gas-permeable walls.

16. The method of any preceding embodiment, further comprising the step of: controlling gas diffusion across the gas-permeable walls to regulate a rate of flow of the sample fluid into the fluid channels.

17. The method of any preceding embodiment: wherein the fluid channel comprises a plurality of dead-end wells; and wherein the method further comprises sequentially drawing the fluid sample into the plurality of dead-end wells.

18. The method of any preceding embodiment: wherein the fluid channel further comprises a reservoir; and wherein advancing the fluid sample comprises advancing the fluid sample from the location to the fluid channel and reservoir.

19. The method of any preceding embodiment: wherein the fluid channel further comprises a reservoir; wherein the location comprises an inlet to the fluid channel; and wherein advancing the fluid sample comprises advancing the fluid sample from the inlet sequentially into the plurality of dead-end wells, the reservoir, and then into the plurality of fluid channels.

20. The method of any preceding embodiment, wherein storing the chip to maintain the vacuum comprises storing the chip for at least a day prior to release of the chip from the vacuum state.

21. A portable device for pumping a fluid sample, comprising: a chip comprising a plurality of vacuum channels and a plurality of fluid channels; a vacuum battery void disposed within the chip; the vacuum battery void comprising a volume configured to store a vacuum upon subjecting the chip to a vacuum state; wherein the plurality of vacuum channels are adjacent with the plurality of fluid channels to form a vacuum lung of thin gas-permeable walls disposed between the plurality of vacuum channels and plurality of fluid channels; wherein the plurality of vacuum channels are coupled to and in communication with the vacuum battery void; wherein the plurality of vacuum channels and plurality of spaced apart fluid channels are not physically connected to each other; and wherein upon release of the chip from the vacuum state, the stored vacuum within the vacuum battery void passively draws air across the thin gas-permeable walls into the vacuum battery void to advance the fluid sample into the plurality of spaced apart fluid channels.

22. The portable device of any preceding embodiment, wherein the vacuum lung is configured to mimic lung alveoli gas exchange by allowing air to diffuse through the thin gas permeable walls across the fluid channels and the vacuum channels and vacuum battery void.

23. The portable device of any preceding embodiment, wherein the lung is configured to control gas diffusion across the gas-permeable walls, thereby regulating flow properties of fluid in the plurality of fluid channels.

24. The portable device of any preceding embodiment, further comprising: a plurality of dead-end wells coupled to the plurality of fluid channels; wherein the fluid sample is configured to be sequentially drawn into the plurality of dead-end wells.

25. The portable device of any preceding embodiment, further comprising: a plurality of auxiliary vacuum channels inter-digitated with the plurality of dead end wells to for a second set of thin gas-permeable walls between the dead-end wells and auxiliary vacuum channels; and wherein upon release of the chip from the vacuum state, air is drawn across the second set of thin gas-permeable walls to advance the into the plurality of dead-end wells.

26. The portable device of any preceding embodiment, further comprising: an auxiliary vacuum battery void coupled to the auxiliary vacuum channels; the auxiliary vacuum battery void comprising a volume configured to store a vacuum upon subjecting the chip to a vacuum state; wherein upon release of the chip from the vacuum state, the stored vacuum within the auxiliary vacuum battery void draws air across the second set of thin gas-permeable walls to advance the fluid sample into the plurality of dead-end wells.

27. The portable device of any preceding embodiment, further comprising: a reservoir coupled to the plurality of fluid channels; wherein upon release of the chip from the vacuum state, the fluid sample is advanced from the plurality of fluid channels and into the reservoir.

28. The portable device of any preceding embodiment: wherein the chip further comprises a reservoir and an inlet coupled to the plurality of fluid channels, the inlet disposed at a location on the chip; and wherein upon release of the chip from the vacuum state, the fluid sample is sequentially advanced from the inlet into the plurality of dead-end wells, into the reservoir, and then into the plurality of fluid channels.

29. The portable device of any preceding embodiment, wherein the chip comprises: a first layer of gas-permeable material; the first layer comprising one or more of the plurality of vacuum channels, plurality of fluid channels, and battery vacuum void; and a second layer capping the first layer to close off one or more of the plurality of vacuum channels, plurality of fluid channels, and battery vacuum void.

30. The portable device of any preceding embodiment: wherein the chip comprises multiple layers; and wherein one or more of the vacuum channels, fluid channels, and battery vacuum void are disposed on separate layers.

31. The portable device of any preceding embodiment, further comprising; a pair of non-permeable layers coupled to top and bottom surfaces of the chip.

32. The portable device of any preceding embodiment, further comprising a containment for maintaining the chip in said vacuum state prior to release of said vacuum state.

Although the description herein contains many details, these should not be construed as limiting the scope of the disclosure but as merely providing illustrations of some of the presently preferred embodiments. Therefore, it will be appreciated that the scope of the disclosure fully encompasses other embodiments which may become obvious to those skilled in the art.

In the claims, reference to an element in the singular is not intended to mean "one and only one" unless explicitly so stated, but rather "one or more." All structural, chemical, and functional equivalents to the elements of the disclosed embodiments that are known to those of ordinary skill in the art are expressly incorporated herein by reference and are intended to be encompassed by the present claims. Furthermore, no element, component, or method step in the present disclosure is intended to be dedicated to the public regardless of whether the element, component, or method step is explicitly recited in the claims. No claim element herein is to be construed as a "means plus function" element unless the element is expressly recited using the phrase "means for". No claim element herein is to be construed as a "step plus function" element unless the element is expressly recited using the phrase "step for".

What is claimed is:

1. A system for portable power-free fluidic pumping, the system comprising:

a chip;

a void disposed within the chip;

the void comprising a volume completely enclosed within the chip, the void configured to store a vacuum upon subjecting the chip to a vacuum state;

one or more vacuum channels coupled to and in communication with the void;

one or more fluid channels, each fluid channel disposed adjacent to a vacuum channel such that a thin gas-permeable wall of material is disposed between the fluid channel and the vacuum channel;

wherein the fluid channel and vacuum channel are not physically connected to each other; and a containment for maintaining the chip in said vacuum state;

wherein upon release of the chip from the vacuum state in the containment, the stored vacuum within the void passively draws air across the thin gas-permeable wall into the void to advance a fluid sample into the fluid channel.

2. The system of claim 1:

wherein the vacuum channels are inter-digitated with the fluid channels to form a vacuum lung of thin gas-permeable walls.

3. The system of claim 2, wherein the vacuum lung is configured to mimic lung alveoli gas exchange by allowing air to diffuse across the thin gas-permeable walls between the fluid channels and the vacuum channels and void.

4. The system of claim 2, wherein the lung is configured to control gas diffusion across the thin gas-permeable walls, thereby regulating flow properties of fluid in the fluid channels.

5. The system of claim 2:

wherein the fluid channel further comprises a plurality of dead-end wells coupled in series; and wherein the fluid sample is configured to be sequentially drawn into the plurality of dead-end wells.

6. The system of claim 5, further comprising:

a plurality of auxiliary vacuum channels inter-digitated with the plurality of dead end wells to form a second set of thin gas-permeable walls between the dead-end wells and auxiliary vacuum channels; and wherein upon release of the chip from the vacuum state, air is drawn across the second set of thin gas-permeable walls to advance the fluid sample into the plurality of dead-end wells.

7. The system of claim 6, further comprising:

an auxiliary void coupled to the auxiliary vacuum channels;

the auxiliary void comprising a volume configured to store a vacuum upon subjecting the chip to a vacuum state;

wherein upon release of the chip from the vacuum state, the stored vacuum within the auxiliary void draws air across the second set of thin gas-permeable walls to advance the fluid sample into the plurality of dead-end wells.

8. The system of claim 1, further comprising:

a reservoir coupled to the fluid channel;

wherein upon release of the chip from the vacuum state, fluid is advanced from the fluid channel into the reservoir along the fluid channel.

9. The system of claim 5, further comprising:

a reservoir coupled to the fluid channel; and an inlet disposed in the chip;

the inlet being coupled to and in communication with the fluid channel and configured to receive a sample fluid;

wherein upon release of the chip from the vacuum state, fluid is advanced from the inlet and sequentially through the plurality of dead-end wells, the reservoir, and then the plurality of fluid channels.

10. The system of claim 1, wherein the chip comprises:

a first layer of gas-permeable material;

the first layer comprising one or more of the vacuum channel, fluid channel, and void; and a second layer capping the first layer to close off one or more of the vacuum channel, fluid channel, and void.

11. The system of claim 1:

wherein the chip comprises multiple layers; and wherein one or more of the vacuum channel, fluid channel, and void are disposed on separate layers.

12. A method for portable fluidic pumping on a chip, the method comprising:

(a) providing the system for portable fluidic pumping, said system comprising:

(i) a chip;

(ii) a void disposed within the chip;

(iii) the void comprising a volume completely enclosed within the chip, the void configured to store a vacuum upon subjecting the chip to a vacuum state;

(iv) a plurality of vacuum channels coupled to and in communication with the void;

(v) a plurality of fluid channels, each fluid channel disposed adjacent to a vacuum channel such that a thin gas-permeable wall of material is disposed between the fluid channel and the vacuum channel;

(vi) a containment for maintaining the chip in said vacuum state;

wherein upon release of the chip from the vacuum state in the containment, the stored vacuum within the void passively draws air across the thin gas-permeable wall into the void to advance a fluid sample into the fluid channel;

(b) applying a vacuum to the chip to charge the chip to store a vacuum within a volume of a void within the chip;

(c) storing the chip to maintain the vacuum;

(d) discharging the chip from the vacuum;

(e) applying a fluid sample at a location on the chip; and (f) passively drawing air across a gas-permeable wall into the void to advance the fluid sample into the fluid channel as a result of the stored vacuum within the void.

13. The method of claim 12, wherein storing the chip to maintain the vacuum comprises placing the chip in a vacuum-sealed pouch.

14. The method of claim 13, wherein discharging the chip comprises opening the vacuum-sealed pouch to break the vacuum.

15. The method of claim 12:

wherein the plurality of vacuum channels are inter-digitated with the plurality of fluid channels to form a vacuum lung of thin gas-permeable walls.

16. The method of claim 15, further comprising the step of:

controlling gas diffusion across the gas-permeable walls to regulate a rate of flow of the sample fluid into the fluid channels.

17. The method of claim 12:

wherein the fluid channel comprises a plurality of dead-end wells; and wherein the method further comprises sequentially drawing the fluid sample into the plurality of dead-end wells.

18. The method of claim 12:

wherein the fluid channel further comprises a reservoir; and wherein advancing the fluid sample comprises advancing the fluid sample from a chip location to the fluid channel and reservoir.

19. The method of claim 12:

wherein the fluid channel further comprises an inlet, a plurality of dead-end wells and a reservoir; and wherein advancing the fluid sample comprises advancing the fluid sample from the inlet sequentially into the plurality of dead-end wells, the reservoir, and then into the plurality of fluid channels.

20. The method of claim 12, wherein storing the chip to maintain the vacuum comprises storing the chip for at least a day prior to release of the chip from the vacuum state.

21. A portable device for pumping a fluid sample, comprising:

a chip comprising a plurality of vacuum channels and a plurality of fluid channels;

a vacuum battery void disposed within the chip;

the vacuum battery void comprising a volume completely enclosed within the chip, the void configured to store a vacuum upon subjecting the chip to a vacuum state;

wherein the plurality of vacuum channels are adjacent with the plurality of fluid channels;

wherein the plurality of vacuum channels are inter-digitated with the plurality of fluid channels to form a vacuum lung of thin gas-permeable walls;

wherein the plurality of vacuum channels are coupled to and in communication with the vacuum battery void;

wherein the plurality of vacuum channels and plurality of spaced apart fluid channels are not physically connected to each other; and wherein upon release of the chip from the vacuum state, the stored vacuum within the vacuum battery void passively draws air across the thin gas-permeable walls into the vacuum battery void to advance the fluid sample into the plurality of spaced apart fluid channels.

22. The portable device of claim 21, wherein the vacuum lung is configured to mimic lung alveoli gas exchange by allowing air to diffuse through the thin gas permeable walls across the fluid channels and the vacuum channels and vacuum battery void.

23. The portable device of claim 22, wherein the lung is configured to control gas diffusion across the gas-permeable walls, thereby regulating flow properties of fluid in the plurality of fluid channels.

24. The portable device of claim 21, further comprising:

a plurality of dead-end wells coupled to the plurality of fluid channels;

wherein the fluid sample is configured to be sequentially drawn into the plurality of dead-end wells.

25. The portable device of claim 24, further comprising:

a plurality of auxiliary vacuum channels inter-digitated with the plurality of dead end wells to for a second set of thin gas-permeable walls between the dead-end wells and auxiliary vacuum channels; and wherein upon release of the chip from the vacuum state, air is drawn across the second set of thin gas-permeable walls to advance the into the plurality of dead-end wells.

26. The portable device of claim 25, further comprising:

an auxiliary vacuum battery void coupled to the auxiliary vacuum channels;

the auxiliary vacuum battery void comprising a volume configured to store a vacuum upon subjecting the chip to a vacuum state;

wherein upon release of the chip from the vacuum state, the stored vacuum within the auxiliary vacuum battery void draws air across the second set of thin gas-permeable walls to advance the fluid sample into the plurality of dead-end wells.

27. The portable device of claim 21, further comprising:

a reservoir coupled to the plurality of fluid channels;

wherein upon release of the chip from the vacuum state, the fluid sample is advanced from the plurality of fluid channels and into the reservoir.

28. The portable device of claim 24:

wherein the chip further comprises a reservoir and an inlet coupled to the plurality of fluid channels, the inlet disposed at a location on the chip; and wherein upon release of the chip from the vacuum state, the fluid sample is sequentially advanced from the inlet into the plurality of dead-end wells, into the reservoir, and then into the plurality of fluid channels.

29. The portable device of claim 21, wherein the chip comprises:

a first layer of gas-permeable material;

the first layer comprising one or more of the plurality of vacuum channels, plurality of fluid channels, and battery vacuum void; and a second layer capping the first layer to close off one or more of the plurality of vacuum channels, plurality of fluid channels, and battery vacuum void.

30. The portable device of claim 21:

wherein the chip comprises multiple layers; and wherein one or more of the vacuum channels, fluid channels, and battery vacuum void are disposed on separate layers.

31. The portable device of claim 21, further comprising;

a pair of non-permeable layers coupled to top and bottom surfaces of the chip.

32. The portable device of claim 21, further comprising a containment for maintaining the chip in said vacuum state prior to release of said vacuum state.

* * * * *